US005967245A

United States Patent [19]

Garcia et al.

[11] Patent Number: 5,967,245

[45] Date of Patent: Oct. 19, 1999

[54] ROLLING CONE BIT HAVING GAGE AND NESTLED GAGE CUTTER ELEMENTS HAVING ENHANCEMENTS IN MATERIALS AND GEOMETRY TO OPTIMIZE BOREHOLE CORNER CUTTING DUTY

[75] Inventors: Gary Edward Garcia, The Woodlands; Gary Ray Portwood, Kingwood; James Carl Minikus, Spring; Per Ivar Nese, Houston; Dennis Cisneros, Kingwood; Chris Edward Cawthorne, The Woodlands, all of Tex.; Madapusi K. Keshavan, Sandy, Utah

[73] Assignee: Smith International, Inc.

[21] Appl. No.: 08/879,874

[22] Filed: Jun. 20, 1997

Related U.S. Application Data

[60] Provisional application No. 60/020,239, Jun. 21, 1996.

[51] Int. Cl.[6] ..... E21B 10/16

[52] U.S. Cl. ..... 175/374; 175/378; 175/431

[58] Field of Search ..... 175/331, 341, 175/374, 378, 431, 434

[56] References Cited

U.S. PATENT DOCUMENTS

| | | | |
|---|---|---|---|
| Re. 33,757 | 12/1991 | Weaver | 175/329 |
| Re. 34,435 | 11/1993 | Warren et al. | 175/398 |
| 2,947,608 | 8/1960 | Hall | 23/209.1 |
| 2,947,617 | 8/1960 | Wentorf, Jr. | 51/307 |
| 3,401,759 | 9/1968 | White | 175/341 |
| 3,518,756 | 7/1970 | Bennett et al. | 29/625 |
| 3,743,556 | 7/1973 | Breton et al. | 156/62.8 |
| 3,778,586 | 12/1973 | Breton et al. | 219/76 |
| 3,819,814 | 6/1974 | Pope | 423/416 |
| 3,876,447 | 4/1975 | Lally | 117/22 |
| 4,036,937 | 7/1977 | Roy et al. | 423/446 |
| 4,106,578 | 8/1978 | Beyer | 175/407 |
| 4,194,040 | 3/1980 | Breton et al. | 428/308 |
| 4,329,271 | 5/1982 | Kemr et al. | 524/386 |
| 4,353,958 | 10/1982 | Kita et al. | 428/329 |
| 4,429,755 | 2/1984 | Williamson | 175/329 |
| 4,444,281 | 4/1984 | Schumacher, Jr. et al. | 175/336 |

(List continued on next page.)

FOREIGN PATENT DOCUMENTS

| | | |
|---|---|---|
| 0554568 | 12/1992 | European Pat. Off. . |
| 473797 | 9/1975 | U.S.S.R. . |

(List continued on next page.)

OTHER PUBLICATIONS

Moreno, Rodrigo, "The Role of Slip Additives in Tape Casting Technology: Part I—Solvents and Dispersants," *American Ceramic Society Bulletin,* vol. 71, No. 10 (Oct. 1992), pp. 1521–1531.

Moreno, Rodrigo, "The Role of Slip Additives in Tape Casting Technology: Part II—Binders and Plasticizers," *American Ceramic Society Bulletin,* vol. 71, No. 11 (Nov. 1992), pp. 1647–1657.

(List continued on next page.)

*Primary Examiner*—William Neuder

*Attorney, Agent, or Firm*—Conley,Rose & Tayon, P.C.

[57] ABSTRACT

A rolling cone bit includes a cone cutter having a gage row and an adjacent nestled gage row of cutter elements that are positioned on gage so as to divide or share the borehole corner cutting duty. The wear resistance, hardness, toughness and shape of the cutter elements in the adjacent rows are optimized depending upon the type of cutting the respective rows perform, the characteristics of the formation being drilled and the drilling techniques being employed. In most applications, the nestled gage cutter elements will have cutting surfaces that are more wear resistant or harder than the cutting surfaces of the gage cutter elements which experience more bottom hole duty. The nestled gage cutter elements engage the borehole wall with a negative rake angle for increased durability. Preferably, the nestled gage cutter elements have continuously contoured and non-shearing cutting surfaces.

63 Claims, 15 Drawing Sheets

U.S. PATENT DOCUMENTS

| | | | |
|---|---|---|---|
| 4,471,845 | 9/1984 | Jurgens | 175/329 |
| 4,475,606 | 10/1984 | Crow | 175/410 |
| 4,522,633 | 6/1985 | Dyer | 51/307 |
| 4,525,178 | 6/1985 | Hall | 51/309 |
| 4,545,441 | 10/1985 | Williamson | 175/329 |
| 4,604,106 | 8/1986 | Hall et al. | 51/293 |
| 4,629,373 | 12/1986 | Hall | 407/118 |
| 4,694,918 | 9/1987 | Hall | 175/329 |
| 4,722,405 | 2/1988 | Langford, Jr. | 175/374 |
| 4,811,801 | 3/1989 | Salesky et al. | 175/329 |
| 4,832,139 | 5/1989 | Minikus et al. | 175/374 |
| 4,932,484 | 6/1990 | Warren et al. | 175/329 |
| 4,972,637 | 11/1990 | Dyer | 51/295 |
| 5,007,207 | 4/1991 | Phaal | 51/204 |
| 5,033,560 | 7/1991 | Sawyer et al. | 175/410 |
| 5,131,478 | 7/1992 | Brett et al. | 175/57 |
| 5,145,016 | 9/1992 | Estes | 175/331 |
| 5,164,247 | 11/1992 | Solanki et al. | 428/213 |
| 5,172,777 | 12/1992 | Siracki et al. | 175/374 |
| 5,172,779 | 12/1992 | Siracki et al. | 175/420 |
| 5,178,222 | 1/1993 | Jones et al. | 175/398 |
| 5,186,268 | 2/1993 | Clegg | 175/399 |
| 5,197,555 | 3/1993 | Estes | 175/431 |
| 5,222,566 | 6/1993 | Taylor et al. | 175/431 |
| 5,238,075 | 8/1993 | Keith et al. | 175/431 |
| 5,265,685 | 11/1993 | Keith et al. | 175/431 |
| 5,287,936 | 2/1994 | Grimes et al. | 175/331 |
| 5,322,138 | 6/1994 | Siracki et al. | 175/374 |
| 5,323,865 | 6/1994 | Isbell et al. | 175/378 |
| 5,341,890 | 8/1994 | Cawthorne et al. | 175/374 |
| 5,346,025 | 9/1994 | Keith et al. | 175/57 |
| 5,346,026 | 9/1994 | Pessier et al. | 175/331 |
| 5,351,768 | 10/1994 | Scott et al. | 175/374 |
| 5,351,770 | 10/1994 | Cawthorne et al. | 175/374 |
| 5,353,885 | 10/1994 | Hooper et al. | 175/378 |
| 5,377,773 | 1/1995 | Tibbitts | 175/397 |
| 5,407,022 | 4/1995 | Scott et al. | 175/331 |
| 5,415,244 | 5/1995 | Portwood | 175/374 |
| 5,421,424 | 6/1995 | Portwood et al. | 175/374 |
| 5,435,403 | 7/1995 | Tibbitts | 175/432 |
| 5,479,997 | 1/1996 | Scott et al. | 175/374 |
| 5,542,485 | 8/1996 | Pessier et al. | 175/371 |
| 5,592,995 | 1/1997 | Scott et al. | 175/431 |
| 5,813,485 | 9/1998 | Portwood | 175/431 |
| 5,819,861 | 10/1998 | Scott et al. | 175/374 |
| 5,833,020 | 11/1998 | Portwood et al. | 175/374 |

OTHER PUBLICATIONS

Product information sheets: "DeBeers Standard PCD Product Range: Syndite Cutting Tools, Syndite Macrodrill Inserts, Syndie Wire Drawing Die Blanks, Syndax3 Thermally Stable Inserts," published by DeBeers Industrial Diamond Division, 10 pages.

Product information sheets: GE Superabrasives: STRATAPAX™ Drill Blank Products, GEOSET™ Drill Diamond Products, GES 511–516 (Feb. 1989), published by General Electric, Worthington, OH, 2 pages.

Product information booklet: "MegaDiamond Advanced Polycrystalline Diamond Technology," SD–1050 5M (Jun. 1991), published by Smith International, Houston, Texas, 12 pages.

ROLLING CONE BIT HAVING GAGE AND NESTLED GAGE CUTTER ELEMENTS HAVING ENHANCEMENTS IN MATERIALS AND GEOMETRY TO OPTIMIZE BOREHOLE CORNER CUTTING DUTY

CROSS REFERENCE TO RELATED APPLICATIONS

The present application claims the benefit of 35 U.S.C. 111 (b) provisional application Ser. No. 60/020,239 filed Jun. 21, 1996, and entitled Rolling Cone Bit Having Gage and Nestled Gage Cutter Elements Having Enhancements in Materials to Optimize Borehole Comer Cutting Duty.

STATEMENT REGARDING FEDERALLY SPONSORED RESEARCH OR DEVELOPMENT

Not applicable.

FIELD OF THE INVENTION

The invention relates generally to earth-boring bits used to drill a borehole for the ultimate recovery of oil, gas or minerals. More particularly, the invention relates to rolling cone rock bits and to an improved cutting structure for such bits. Still more particularly, the invention relates to enhancements in materials, in conjunction with cutter element placement and shape, to increase bit durability and rate of penetration and enhance the bit's ability to maintain gage.

BACKGROUND OF THE INVENTION

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

A typical earth-boring bit includes one or more rotatable cutters that perform their cutting function due to the rolling movement of the cutters acting against the formation material. The cutters roll and slide upon the bottom of the borehole as the bit is rotated, the cutters thereby engaging and disintegrating the formation material in its path. The rotatable cutters may be described as generally conical in shape and are therefore sometimes referred to as rolling cones. The borehole is formed as the gouging and scraping or crushing and chipping action of the rotary cones remove chips of formation material which are carried upward and out of the borehole by drilling fluid which is pumped downwardly through the drill pipe and out of the bit.

The earth disintegrating action of the rolling cone cutters is enhanced by providing the cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits, while those having teeth formed from the cone material are known as "steel tooth bits." The cutting surfaces of inserts are, in some instances, coated with a very hard and abrasion resistant coating such as polycrystaline diamond (PCD). Similarly, the teeth of steel tooth bits are many times coated with a hard metal layer generally referred to as "hardfacing."

In each instance, the cutter elements on the rotating cutters break up the formation to form new borehole by a combination of gouging and scraping or chipping and crushing.

In oil and gas drilling, the cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer and which are usable over a wider range of formation hardness.

The length of time that a drill bit may be employed before it must be changed depends upon its rate of penetration ("ROP"), as well as its durability or ability to maintain an acceptable ROP. The form and positioning of the cutter elements (both steel teeth and tungsten carbide inserts) upon the cutters greatly impact bit durability and ROP and thus are critical to the success of a particular bit design.

Bit durability is, in part, measured by a bit's ability to "hold gage," meaning its ability to maintain a full gage borehole diameter over the entire length of the borehole. Gage holding ability is particularly vital in directional drilling applications which have become increasingly important. If gage is not maintained at a relatively constant dimension, it becomes more difficult, and thus more costly, to insert drilling apparatus into the borehole than if the borehole had a constant diameter. For example, when a new, unworn bit is inserted into an undergage borehole, the new bit will be required to ream the undergage hole as it progresses toward the bottom of the borehole. Thus, by the time it reaches the bottom, the bit may have experienced a substantial amount of wear that it would not have experienced had the prior bit been able to maintain full gage. This unnecessary wear will shorten the life of the newly-inserted bit, thus prematurely requiring the time consuming and expensive process of removing the drill string, replacing the worn bit, and reinstalling another new bit downhole.

To assist in maintaining the gage of a borehole, conventional rolling cone bits typically employ a heel row of hard metal inserts on the heel surface of the rolling cone cutters. The heel surface is a generally frustoconical surface and is configured and positioned so as to generally align with and ream the sidewall of the borehole as the bit rotates. The inserts in the heel surface contact the borehole wall with a sliding motion and thus generally may be described as scraping or reaming the borehole sidewall. The heel inserts function primarily to maintain a constant gage and secondarily to prevent the erosion and abrasion of the heel surface of the rolling cone. Excessive wear of the heel inserts leads to an undergage borehole, decreased ROP, increased loading on the other cutter elements on the bit, and may accelerate wear of the cutter bearing and ultimately lead to bit failure.

In addition to the heel row inserts, conventional bits typically include a gage row of cutter elements mounted adjacent to the heel surface but orientated and sized in such a manner so as to cut the corner of the borehole. In this orientation, the gage cutter elements generally are required to cut both the borehole bottom and sidewall. The lower surface of the gage row cutter elements engage the borehole bottom while the radially outermost surface scrapes the sidewall of the borehole. Conventional bits also include a number of additional rows of cutter elements that are located on the cones in rows disposed radially inward from the gage row. These cutter elements are sized and configured for cutting the bottom of the borehole and are typically described as inner row cutter elements.

Differing forces are applied to the cutter elements by the sidewall than the borehole bottom. Thus, requiring gage cutter elements to cut both portions of the borehole compromises the cutter element's design. In general, the cutting action operating on the borehole bottom is typically a crushing or gouging action, while the cutting action operating on the sidewall is a scraping or reaming action. Ideally, a crushing or gouging action requires a tough cutter element, one able to withstand high impacts and compressive loading, while the scraping or reaming action calls for a very hard and wear resistant cutter element. One grade of cemented tungsten carbide or hardfacing cannot optimally perform both of these cutting functions as it cannot be as hard as desired for cutting the sidewall and, at the same time, as tough as desired for cutting the borehole bottom. Similarly, PCD grades differ in hardness and toughness and, although PCD coatings are extremely resistant to wear, they are particularly vulnerable to damage caused by impact loading as typically encountered in bottom hole cutting duty. As a result, compromises have been made in conventional bits such that the gage row cutter elements are not as tough as the inner row of cutter elements because they must, at the same time, be harder, more wear resistant and less aggressively shaped so as to accommodate the scraping action on the sidewall of the borehole.

Attempts have been made in the past to design a bit having an increased ability to hold gage. For example, U.S. Pat. No. 5,353,885 discloses a rolling cone bit in which the heel inserts were moved from a traditional location centrally disposed along the heel surface to a position in which their cutting surface, in rotated profile, overlapped with the cutting profile of the gage row inserts. The heel inserts, due to their positioning, engaged the borehole sidewall at points much lower in the borehole and much sooner on the cutting cycle than in pervious heel row inserts. According to the '885 patent, the "lowering" of the heel inserts spared the gage inserts from having to do a large amount of scraping on the borehole sidewall. This was believed advantageous as it permitted the gage inserts to be made of the same tough grade of tungsten carbide as the inner rows of inserts.

That design, however, presented other compromises. For example, the heel surface of the cone was left unprotected by any hard metal inserts, leading to erosion of the cone and the shirttail of the bit leg after the heel inserts and gage inserts became worn. Erosion of the shirttail portion of the bit leg is especially detrimental as the shirttail performs an important role in protecting the cone seal and bearing from exposure to cuttings and other debris. Additionally, although the sidewall cutting duty was shared between heel inserts and gage inserts in the bit of the '885 patent, the gage inserts were still required to perform a substantial amount of sidewall cutting duty. When gage inserts were made of the same tough tungsten carbide as inner row cutter elements as taught by the '885 patent, they are not as resistant to wear caused by sidewall cutting, and are therefore more susceptible to gage rounding than previous gage row inserts which had been made of a harder more wear resistant material.

Another example of an attempt to increase the gage holding ability of a bit is shown in U.S. Pat. No. 5,351,768. The '768 patent teaches including a scraper insert at the intersection of the heel and gage surfaces of a rolling cone. The scraper insert includes a gage surface and a heel surface which converge to define a relatively sharp cutting edge for engagement with the sidewall of the borehole, the insert also being mounted so as to have a positive rake angle with respect to the sidewall. The scraper insert also is positioned in the cone so that it does not initially engage the borehole sidewall, but only begins to engage formation material after the gage inserts (described therein as "heel" inserts) wear to an appreciable degree. The scraper inserts are thus described as a "secondary" rather than a "primary" cutting structure, and make only incidental contact with the formation material until wear has occurred to the gage inserts. Similarly, the '768 patent teaches that the heel row inserts (described therein as "gage" inserts) do not extend to full gage, so as to maintain a clearance between the heel inserts and the sidewall of the borehole. Again, only when the gage and scraper inserts become severely worn do the heel inserts actively cut sidewall.

Although this arrangement was intended to provide an aggressive cutting structure for increased ROP, the shape and the angle with which the scraper insert attacks the borehole wall make it inherently susceptible to premature wear and damage. With its sharp edge, the scraper inserts will have a high peak contact stress, leading to accelerated wear as compared to a more blunt or rounded cutting surface. Further, the sharp leading edges of the scraper insert are subjected to concentrated forces which may tend to cause premature chipping or breakage, especially when the insert is subjected to side impact loading as may be prevalent in particular formations and in directional drilling. Furthermore, the sharp chisel geometry of the scraper increases the frictional force imposed on the insert, and may lead to intensive localized heat generation at the sharp corners of the cutting surface. Such intense localized heating may lead to heat checking and subsequent cutter element failure.

Additionally, the '768 patent discloses forming one side of the scraper insert from a more wear resistant material than the other. In theory, the less wear resistant surface will wear faster than the other surface, such that the scraper insert will be self sharpening. The '768 patent discloses that the more wear resistant material could be PCD. However, due to the shape of the scraper insert, it is difficult to create a strong bond of PCD at the sharp corners, potentially leading to chipping of the PCD at those sharp corners or radii. Furthermore, the resistance force, a component of the force that is applied tangentially to the cutter element as it engages the formation (in the direction opposite of cutting movement) will attack the discontinuity that exists at the tip of the scraper insert at the intersection of the PCD layer with the tungsten carbide. This substantial force, applied at what amounts to an inherent crack can propagate, causing loss of PCD coating as the frictional force and the resistance force (both being components that together make up the tangential force component) attack the intersection of the tungsten carbide and diamond layer.

Significantly too, the scraper inserts engage the borehole sidewall at a positive rake angle. The shape of scraper insert and its orientation so as to form a positive rake angle creates the potential for, at least initially, a relatively high ROP. At the same time, however, the scraper insert may become quickly dulled or broken due to its aggressive rake angle. Also, because of the orientation of the chisel insert as it sweeps across and engages the borehole wall, the intersection between the PCD layer and carbide is particularly susceptible to attack from the tangential forces imposed on the cutter element. More specifically, the tangential forces are applied at the crest of the chisel insert and are applied in a direction such that the diamond coating is particularly susceptible to chipping and delamination because, at least in certain portions of its cutting cycle, there is not a substantial amount of tungsten carbide substrate to support the diamond coating from the tangential forces that are being applied by the hole wall.

Accordingly, there remains a need in the art for a drill bit and cutting structure that is more durable than those conventionally known and that will yield greater ROP's and an increase in footage drilled while maintaining a full gage borehole. Preferably, the bit and cutting structure would not require the compromises in cutter element toughness, wear resistance and hardness which have plagued conventional bits and thereby limited durability and ROP.

SUMMARY OF THE INVENTION

The present invention provides an earth boring bit having enhancements in cutter element placement, in conjunction with materials and shape, for optimizing borehole corner duty. Such enhancements provide the potential for increased bit durability, ROP and footage drilled (at full gage) as compared with similar bits of conventional technology. According to the invention, rows of cutter elements are positioned on a rolling cone cutter in adjacent locations so as to share the borehole corner cutting duty. These cutter elements include gage cutter elements and nestled gage cutter elements which both include cutting surfaces extending to full gage. The nestled gage cutter elements relieve the gage cutter elements from a substantial portion of the sidewall cutting duty, and preferably are positioned so as to engage the borehole with negative back rake. Because of this partial division of corner cutting duty, the nestled gage cutter elements, gage cutter elements and inner row cutter elements may be made of materials having differing degrees of hardness, toughness and wear resistance so as to optimize the bit for a particular formation or drilling application. Additionally, the sharing of corner cutting duty permits particular shapes and orientations of nestled gage cutter elements to be employed advantageously. Preferably, the gage cutter elements will have gage cutting surfaces that are more wear resistant than the cutting surfaces of the inner row cutter elements. In a particularly preferred embodiment, the nestled gage inserts have cutting surfaces that are continuously contoured and entirely coated with PCD.

Thus, the present invention comprises a combination of features and advantages which enable it to substantially advance the drill bit art. The invention permits the cutting function of cutter elements in different rows to be particularly enhanced through the selective use of materials, shapes and orientations that are best suited for the particular duty these cutter elements will experience. Such enhancements provide opportunity for improvement in cutter element life and thus bit durability and ROP potential. These and various other characteristics and advantages of the present invention will be readily apparent to those skilled in the art upon reading the following detailed description of the preferred embodiments of the invention, and by referring to the accompanying drawings.

BRIEF DESCRIPTION OF THE DRAWINGS

For an introduction to the detailed description of the preferred embodiments of the invention, reference will now be made to the accompanying drawings, wherein.

DETAILED DESCRIPTION OF THE PREFERRED EMBODIMENTS

Figure 1:
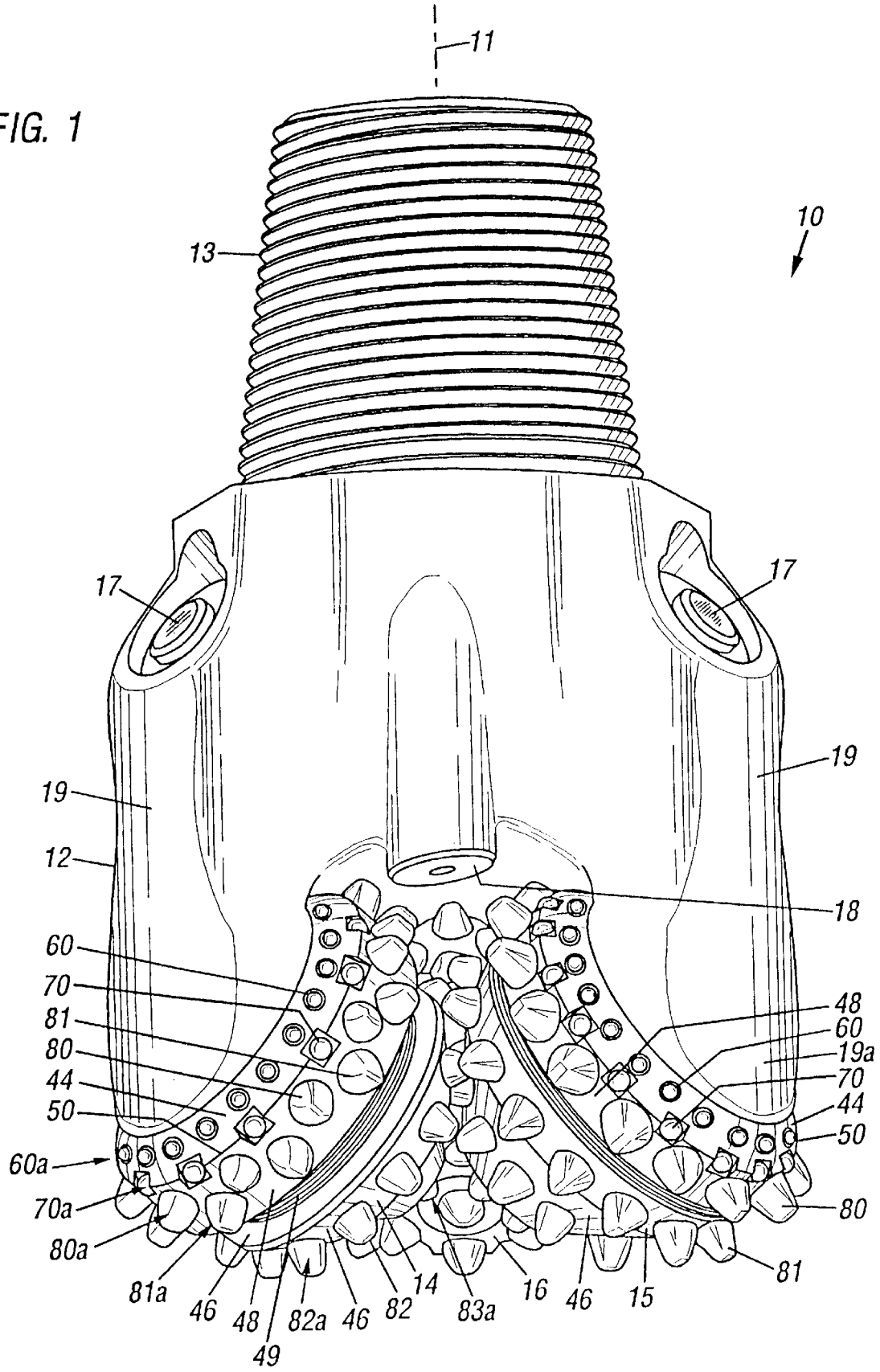
FIG. 1 is a perspective view of an earth-boring bit made in accordance with the principles of the present invention.

Referring first to FIG. 1, an earth-boring bit 10 made in accordance with the present invention includes a central axis 11 and a bit body 12 having a threaded section 13 on its upper end for securing the bit to the drill string (not shown). Bit 10 has a predetermined gage diameter as defined by three rolling cone cutters 14, 15, 16 rotatably mounted on bearing shafts that depend from the bit body 12. Bit body 12 is composed of three sections or legs 19 (two shown in FIG. 1) that are welded together to form bit body 12. Bit 10 further includes a plurality of nozzles 18 that are provided for directing drilling fluid toward the bottom of the borehole and around cutters 14–16, and lubricant reservoirs 17 that supply lubricant to the bearings of each of the cutters. Bit legs 19 include a shirttail portion 19*a* that serves to protect cone bearings and seals from damage caused by cuttings and debris entering between the leg 19 and its respective cone cutters.

Figure 2:
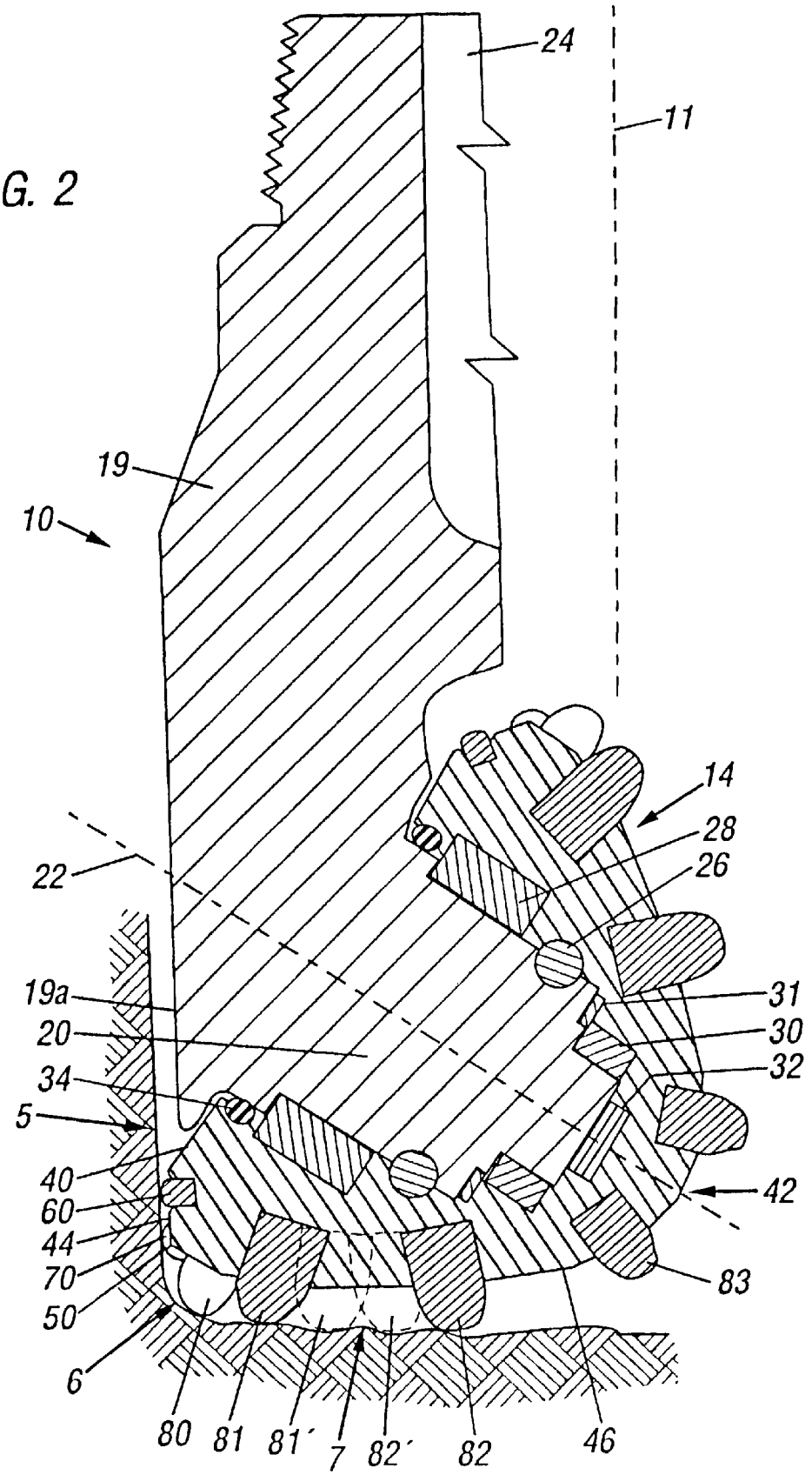
FIG. 2 is a partial section view taken through one leg and one rolling cone cutter of the bit shown in FIG. 1.

Referring now to FIG. 2, in conjunction with FIG. 1, each cutter 14–16 is rotatably mounted on a pin or journal 20, with an axis of rotation 22 oriented generally downwardly and inwardly toward the center of the bit. Drilling fluid is pumped from the surface through fluid passage 24 where it is circulated through an internal passageway (not shown) to nozzles 18 (FIG. 1). Each cutter 14–16 is typically secured on pin 20 by locking balls 26. In the embodiment shown, radial and axial thrust are absorbed by roller bearings 28, 30, thrust washer 31 and thrust plug 32; however, the invention is not limited to use in a roller bearing bit, but may equally be applied in a friction bearing bit, where cones 14, 15, 16 would be mounted on pins 20 without roller bearings 28, 30. In both roller bearing and friction bearing bits, lubricant may be supplied from reservoir 17 to the bearings by apparatus that is omitted from the figures for clarity. The lubricant is sealed and drilling fluid excluded by means of an annular seal 34. The borehole created by bit 10 includes sidewall 5, corner portion 6 and bottom 7, best shown in FIG. 2.

Referring still to FIGS. 1 and 2, each cutter 14–16 includes a backface 40 and nose portion 42. Cutters 14–16 further include a frustoconical surface 44 that is adapted to retain cutter elements that scrape or ream the sidewalls of the borehole as cutters 14-16 rotate about the borehole bottom. Frustoconical surface 44 will be referred to herein as the "heel" surface of cutters 14–16, it being understood, however, that the same surface may be sometimes referred to by others in the art as the "gage" surface of a rolling cone cutter.

Extending between heel surface 44 and nose 42 is a generally conical surface 46 adapted for supporting cutter elements that gouge or crush the borehole bottom 7 as the cone cutters rotate about the borehole. Conical surface 46 typically includes a plurality of generally frustoconical segments 48 generally referred to as "lands" which are employed to support and secure the cutter elements as described in more detail below. Grooves 49 are formed in cone surface 46 between adjacent lands 48. Frustoconical heel surface 44 and conical surface 46 converge in a circumferential edge or shoulder 50. Although referred to herein as an "edge" or "shoulder," it should be understood that shoulder 50 may be contoured, such as a radius, to various degrees such that shoulder 50 will define a contoured zone of convergence between frustoconical heel surface 44 and the conical surface 46.

In the embodiment of the invention shown in FIGS. 1 and 2, each cutter 14–16 includes a plurality of wear resistant inserts 60, 70, 80. Inserts 60, 70, 80 each include a generally cylindrical base portion and a cutting portion that extends from the base portion and includes a cutting surface for cutting formation material. All or a portion of the base portion is secured by interference fit into a mating socket drilled into the lands of the cone cutter. The "cutting surface" of an insert is defined herein as being that surface of the insert that extends beyond the cylindrical base. The present invention will be understood with reference to one such cutter 14, cones 15, 16 being similarly, although not necessarily identically, configured.

Cone cutter 14 includes a plurality of heel row inserts 60 that are secured in a circumferential row 60*a* in the frustoconical heel surface 44. Cutter 14 further includes a circumferential row 70*a* of nestled gage inserts 70 secured to cutter 14 in locations along or near the circumferential shoulder 50, and a row 80*a* of gage inserts 80 on surface 46. Inserts 70 are referred to as "nestled" because of their mounting position relative to the position of gage inserts 80, in that one or more insert 70 is mounted in cone 14 between a pair of inserts 80 that are adjacent to one another in gage row 80*a*. Cutter 14 further includes a plurality of inner row inserts 81, 82, 83 secured to cone surface 46 and arranged in spaced-apart inner rows 81*a*, 82*a*, 83*a*, respectively. Relieved areas or lands 78 (best shown in FIG. 3) are formed about nestled gage inserts 70 to assist in mounting inserts 70. Heel inserts 60 generally function to scrape or ream the borehole sidewall 5 to maintain the borehole at full gage, and prevent erosion and abrasion of heel surface 44 and to protect the shirttail portion 19*a* of bit leg 19. Cutter elements 81, 82 and 83 of inner rows 81*a*, 82*a*, 83*a* are employed primarily to gouge and remove formation material from the borehole bottom 7. Inner rows 81*a*, 82*a*, 83*a* are arranged and spaced on cutter 14 so as not to interfere with the inner rows on each of the other cone cutters 15, 16.

Figure 9:
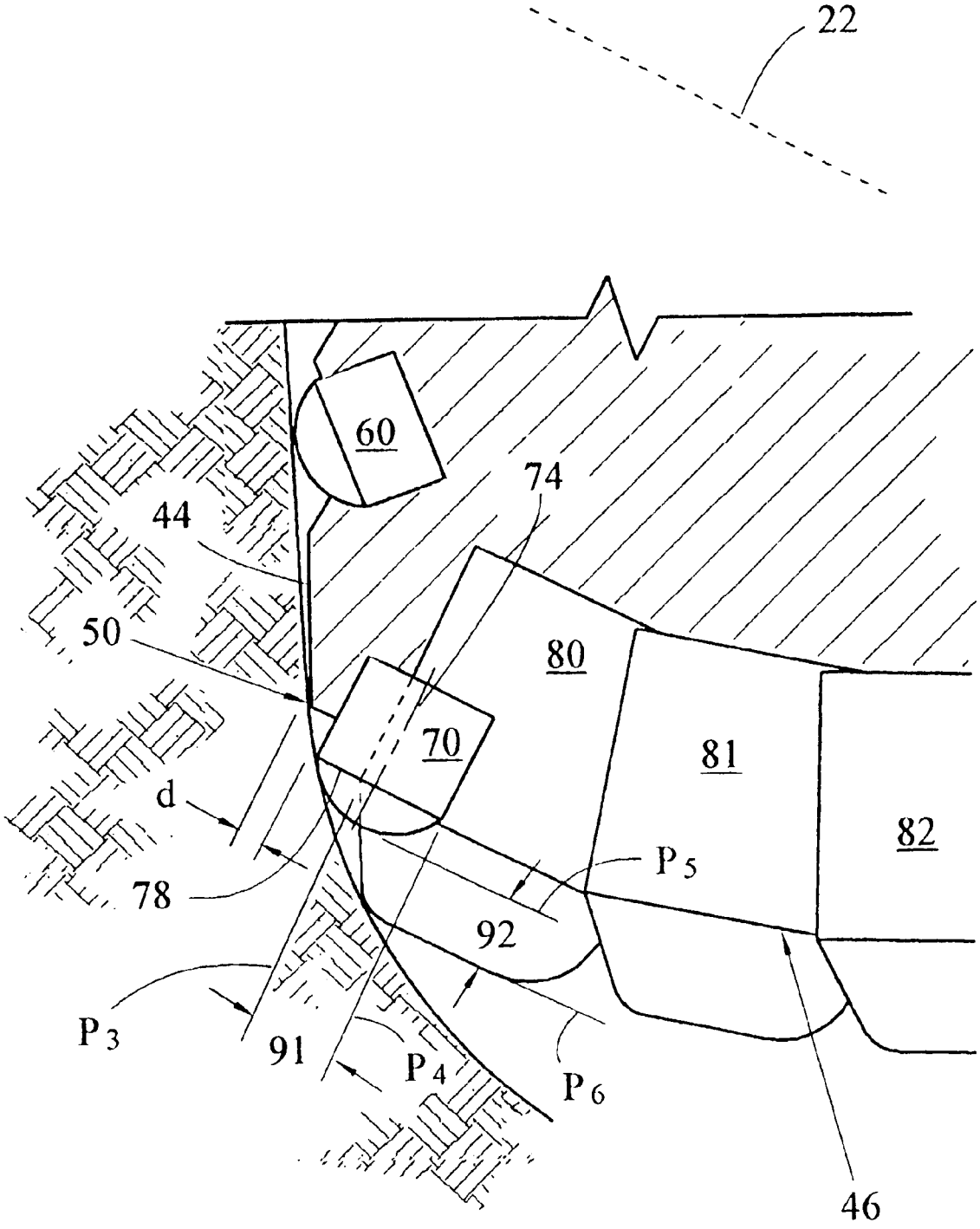
FIG. 9 is a cross sectional view of a portion of rolling cone cutter showing another alternative embodiment of the invention.

As shown in FIGS. 1–4, the preferred placement of nestled gage cutter elements 70 is a position along circumferential shoulder 50. This mounting position enhances bit 10's ability to divide corner cutter duty among inserts 70 and 80 as described more fully below. This position also enhances the drilling fluid's ability to clean the inserts and to wash the formation chips and cuttings past heel surface 44 towards the top of the borehole. Despite the advantage of this mounting position, many of the substantial benefits of the present invention may be achieved where inserts 70 are positioned adjacent to circumferential shoulder 50, on either conical surface 46 (FIG. 9) or on heel surface 44 (FIG. 5). For bits having nestled gage cutter elements 70 positioned adjacent to shoulder 50, the precise distance of nestled gage cutter elements 70 to shoulder 50 will generally vary with bit size: the larger the bit, the further cutter element 70 can be positioned from shoulder 50 while still providing the desired division of corner cutting duty between cutter elements 70 and 80. The benefits of the invention diminish, however, if nestled gage cutter element 70 are positioned too far from shoulder 50, particularly when placed on heel surface 44. The distance between shoulder 50 to nestled gage cutter elements 70 is measured from shoulder 50 to the nearest edge of the nestled gage cutter element 70, the distance represented by "d" as shown in FIGS. 9 & 5. Thus, as used herein to describe the mounting position of nestled gage cutter elements 70 relative to shoulder 50, the term "adjacent" shall mean on shoulder 50 or on either surface 46 or 44 within the ranges set forth in Table 1 below:

TABLE 1

| Bit Diameter "BD" (inches) | Distance "d" from Shoulder 50 Along Surface 46 (inches) | Distance "d" from Shoulder 50 Along Heel Surface 44 (inches) |
|---|---|---|
| BD ≦ 7 | 0 ≦ d ≦ .120 | 0 ≦ d ≦ .060 |
| 7 < BD ≦ 10 | 0 ≦ d ≦ .180 | 0 ≦ d ≦ .090 |
| 10 < BD ≦ 15 | 0 ≦ d ≦ .250 | 0 ≦ d ≦ .130 |
| BD > 15 | 0 ≦ d ≦ .300 | 0 ≦ d ≦ .150 |

Figure 3:
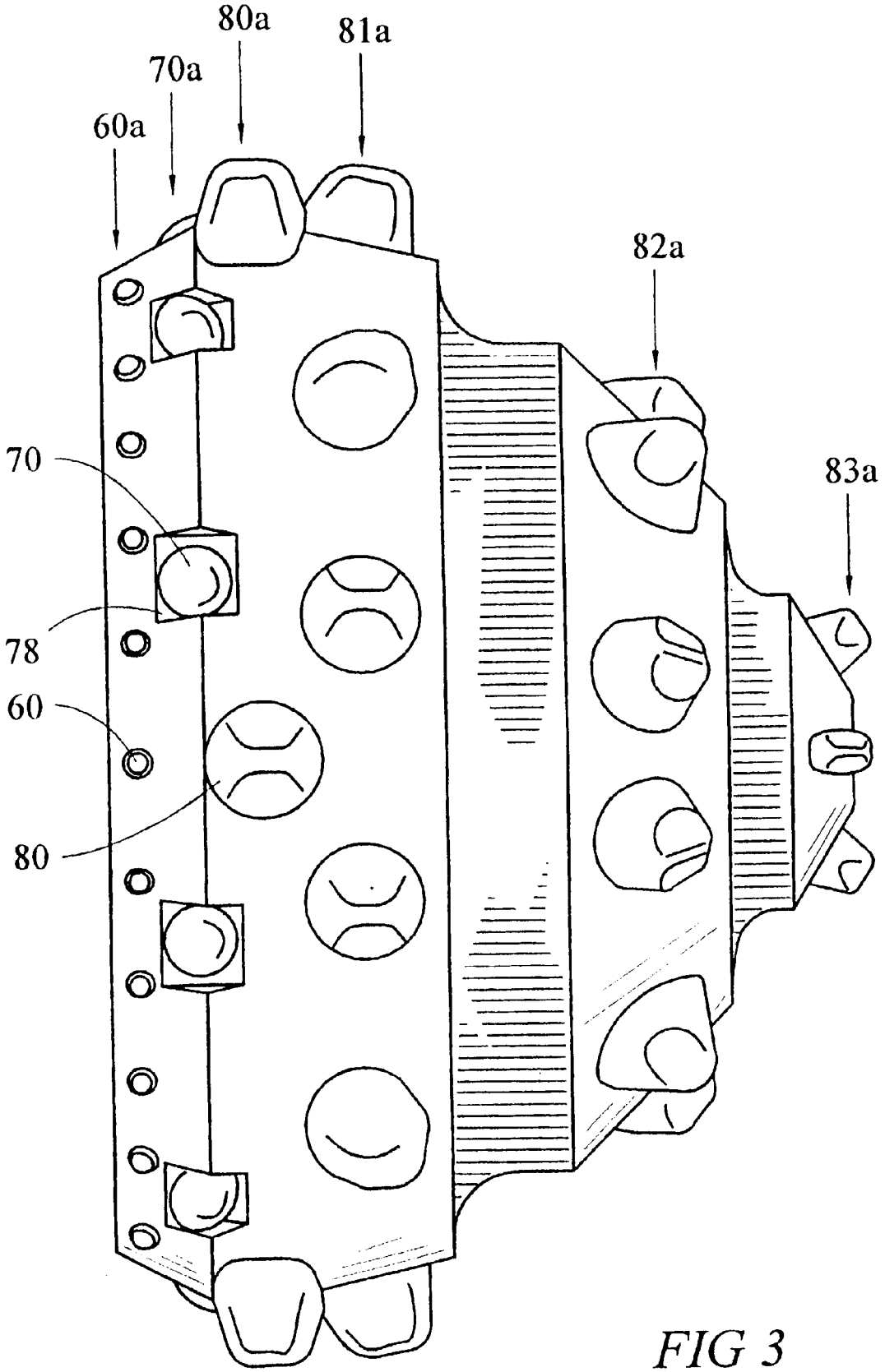
FIG. 3 is a perspective view of one cutter of the bit of FIG. 1.

The spacing between heel inserts 60, nestled gage inserts 70, gage inserts 80 and inner row inserts 81–83, is best shown in FIG. 2 and 3. FIG. 2 also shows the cutting profiles of inserts 60, 70, 80 as viewed in rotated profile, that is with the cutting profiles of the cutter elements shown rotated into a single plane. The rotated cutting profiles and cutting position of inner row inserts 81', 82', inserts that are mounted and positioned on cones 15, 16 to cut formation material between inserts 81, 82 of cone cutter 14, are also shown in phantom. Due to their positioning, it can be seen that nestled gage inserts 70 cut primarily against sidewall 5 while gage inserts 80 act both against the borehole bottom 7 and against the side wall 5.

Figure 4:
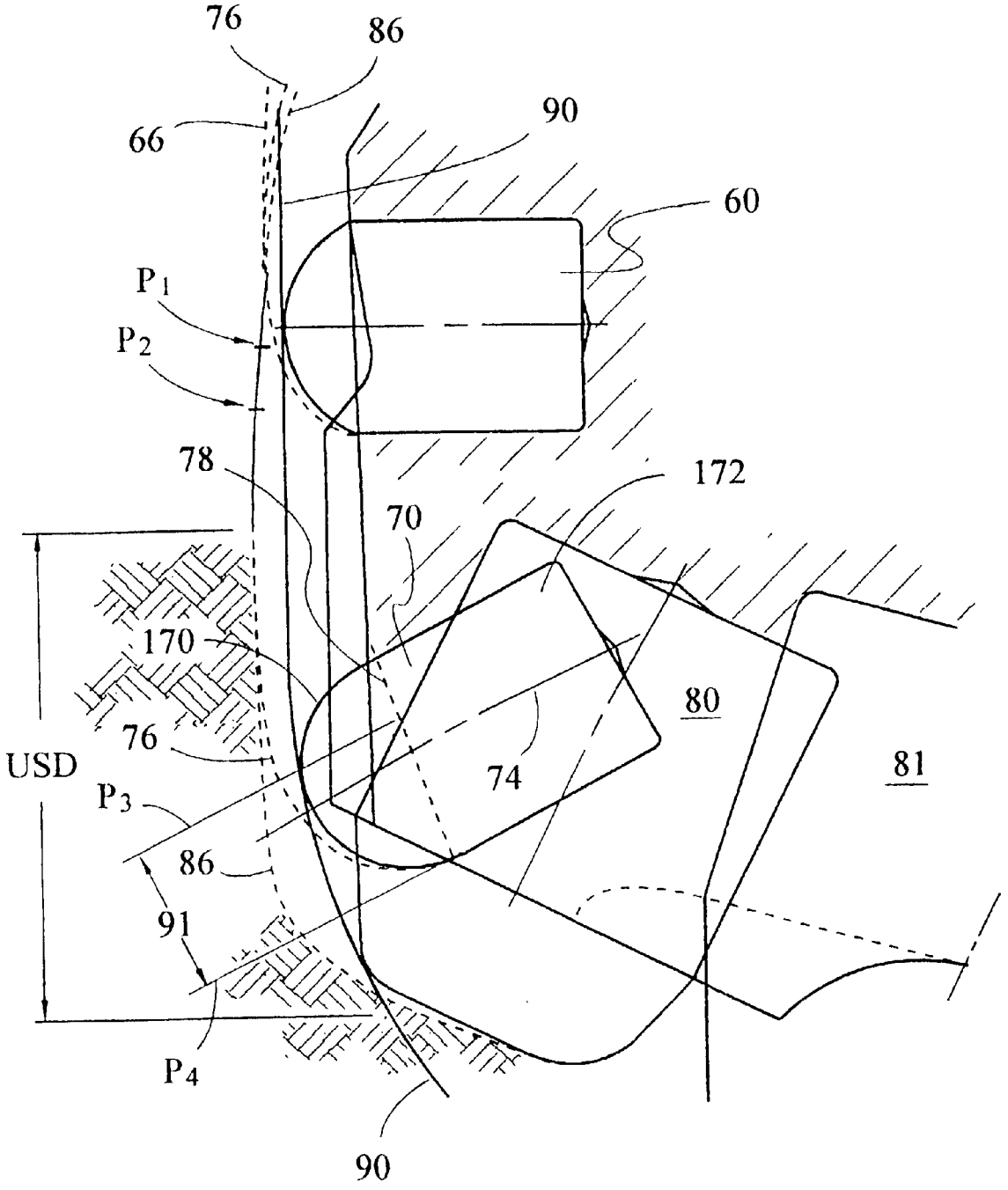
FIG. 4 is a enlarged view, partially in cross-section, of a portion of the cutting structure of the cutter shown in FIGS. 2 and 3, and showing the cutting paths traced by certain of the cutter elements mounted on that cutter.
Figure 5:
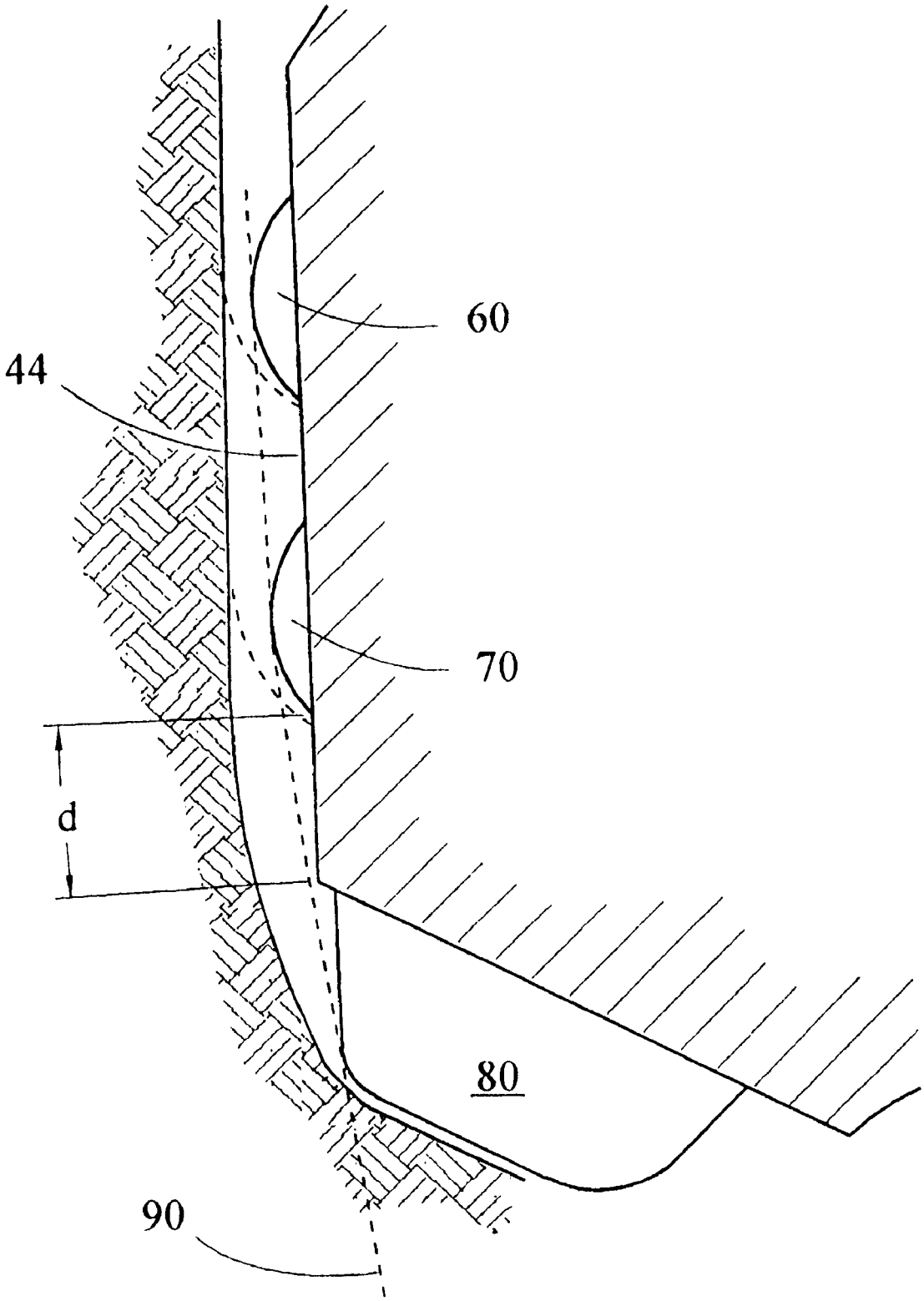
FIG. 5 is a view similar to FIG. 4 showing an alternative embodiment of the invention.

The cutting paths taken by inserts 60, 70 and 80 are shown in more detail in FIG. 4. Referring to FIGS. 2 and 4, each insert 60, 70, 80 will cut formation material as cone 14 is rotated about its axis 22. As bit 10 descends further into the formation material, the cutting paths traced by inserts 60, 70, 80 may be depicted as a series of curves. In particular: heel row inserts 60 will cut along curve 66; nestled gage row inserts 70 will cut along curve 76; and gage row inserts 80 will cut along curve 86. As shown in FIG. 4, curve 76 traced by nestled gage insert 70 passes through a most radially distant point $P_1$ as measured from bit axis 11. Likewise, the most radially distance point on curve 86 is denoted by $P_2$.

The American Petroleum Institute ("API") has established standards that define nominal bit diameters. According to those standards, a bit will be classified as having a particular nominal gage diameter if the bit's actual diameter falls with specified maximums and minimums as established by API for the given nominal diameter. As used herein, for a bit having a given nominal gage diameter, cutter elements in the position of nestled gage inserts 70 and gage inserts 80 are both considered "on gage" or extending to "full gage" when: (1) the radially outermost point P1 on the cutting path of the cutter element in the position of nestled gage insert 70 is within the maximum and minimum limits set by API for that given nominal gage diameter; and (2) the radially outermost point P2 on the cutting path of the cutter element in the position of gage insert 80 is either: (a) within the maximum and minimum limits set by API for that given nominal gage diameter; or (b) is less than or equal to the maximum limit set by API for the given nominal gage diameter and, simultaneously, is radially inward from point PI by not more than a distance "G" (defined in Table 2 below).

TABLE 2

| Bit Diameter "BD" (Inches) | Distance "G" (Inches) |
|---|---|
| 3⅜ ≦ BD ≦ 13¾ | .016 (1/64) |
| 14 ≦ BD ≦ 17½ | .031 (1/32) |
| 17⅝ < BD | .047 (3/64) |

According to these definitions, it will be understood that a nestled gage cutter element 70 and a gage cutter element 80 may both be "on gage" or extend to "full gage diameter" as claimed herein even where the outermost point P2 on the cutting path of gage cutter element 80 falls slightly below the minimum API standards for a given nominal bit diameter.

In the present invention, it is preferred that heel inserts 60 also extend to full gage. As used herein, for a bit of a given nominal gage diameter, a heel insert 60 extends to "full gage" or is "on gage" when the radially outermost point on its cutting path 66 (FIG. 4) is within the maximum and minimum limits set by API for a given nominal gage diameter.

A portion of gage curve 90 of bit 10 is depicted in FIG. 4. As understood by those skilled in the art of designing bits, a "gage curve" is commonly employed as a design tool to ensure that a bit made in accordance to a particular design will cut the specified hole diameter. The gage curve is a complex mathematical formulation which, based upon the parameters of bit diameter, journal angle, and journal offset, takes all the points that will cut the specified hole size, as located in three dimensional space, and projects these points into a two dimensional plane which contains the journal centerline and is parallel to the bit axis. The use of the gage curve greatly simplifies the bit design process as it allows the cutter elements to be accurately located in two dimensional space which is easier to visualize. The gage curve, however, should not be confused with the cutting path of any individual cutting element as described previously. Referring again to FIGS. 2 and 4, it is shown that nestled gage inserts 70 and gage inserts 80 cooperatively operate to cut the corner 6 of the borehole, while inner row inserts 81, 82, 83 attack the borehole bottom. Meanwhile, heel row inserts 60 scrape or ream the sidewalls of the borehole, but perform no corner cutting duty because of the relatively large distance that heel row inserts 60 are separated from nestled gage row inserts 70. Inserts 70 and 80 are referred to as "primary" cutting structures or elements in that they work in unison or concert to simultaneously cut the borehole corner, cutter elements 70 and 80 each engaging the formation material and performing their intended cutting finction immediately upon the initiation of drilling by bit 10. Cutter elements 70, 80 are thus to be distinguished from what are sometimes referred to as "secondary" cutting structures or cutter elements which engage formation material only after other cutter elements have become worn.

As previously mentioned, nestled gage row cutter elements 70 may be positioned on heel surface 44, such an arrangement being shown in FIG. 5. Like the arrangement shown in FIG. 4, the cutter elements 70, 80 extend to full gage, and the borehole corner cutting duty is divided among the nestled gage cutter elements 70 and gage cutter elements 80. Although in this embodiment nestled gage cutter elements 70 are located on the heel surface 44 along with heel row inserts 60, heel inserts 60 are still too far away to assist in the corner cutting duty.

Figure 6:
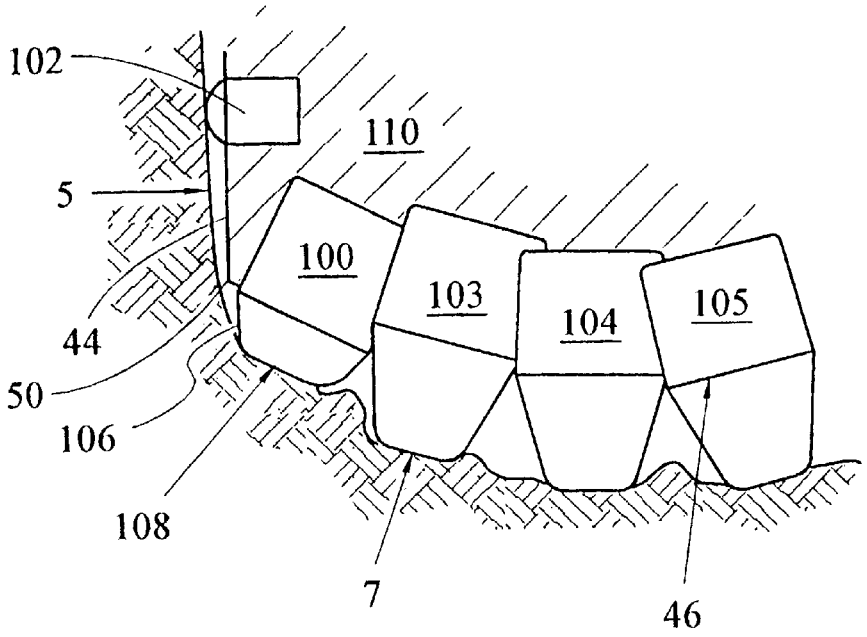
FIG 6 (Prior Art)
FIG. 6 is a partial cross sectional view of a set of prior art rolling cone cutters (shown in rotated profile) and the cutter elements attached thereto.
Figure 7:
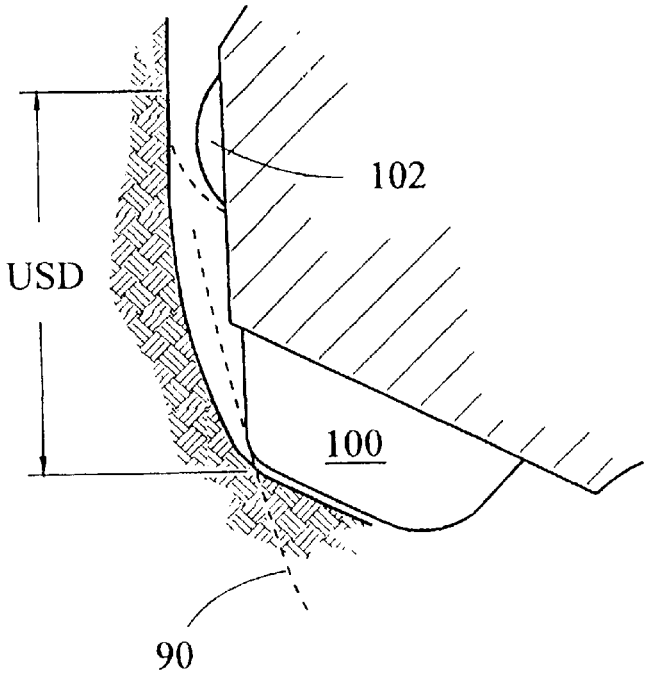
FIG 7 (Prior Art)
FIG. 7 is an enlarged cross sectional view of a portion of the cutting structure of the prior art cutter shown in FIG. 6 and showing the cutting paths traced by certain of the cutter elements.

Referring to FIGS. 6 and 7, a typical prior art bit 110 is shown to have gage row inserts 100, heel row inserts 102 and inner row inserts 103, 104, 105. By contrast to the present invention, such conventional bits have typically employed cone cutters having a single row of cutter elements that are positioned on gage to cut the borehole corner. Gage inserts 100, as well as inner row inserts 103–105 are generally mounted on the conical surface 46, while heel row inserts 102 are mounted on heel surface 44. In this arrangement, the gage row inserts 100 are required to cut the borehole corner without any significant assistance from any other cutter elements as best shown in FIG. 7. This is because the first inner row inserts 103 and heel inserts 102 are mounted a substantial distance from gage inserts 100 and thus are too far away to be able to assist in cutting the borehole corner. Accordingly, gage inserts 100 traditionally have alone had to cut both the borehole sidewall 5 along cutting surface 106, as well as cut the borehole bottom 7 along the cutting surface shown generally at 108. Because they have typically been required to perform both cutting duties, a compromise in the toughness, wear resistance, shape and other properties of gage inserts 100 has been required.

The failure mode of cutter elements usually manifests itself as either breakage, wear, or mechanical or thermal fatigue. Wear and thermal fatigue are typically results of abrasion as the elements act against the formation material. Breakage, including chipping of the cutter element, typically results from impact loads, although thermal and mechanical fatigue of the cutter element can also initiate breakage.

Referring still to FIG. 6, breakage of prior art gage inserts 100 was not uncommon because of the compromise in toughness that had to be made in order for inserts 100 to also withstand the sidewall cutting they were required to perform. Likewise, prior art gage inserts 100 were sometimes subject to rapid wear and thermal fatigue due to the compromise in wear resistance that was made in order to allow the inserts to simultaneously withstand the impact loading typically present in bottom hole cutting.

Referring again to FIGS. 1–4, it has been determined that positioning nestled gage cutter elements 70 in relative close proximity to gage inserts 80 that substantial improvements may be achieved in ROP or bit durability, or both. To achieve these results, it is important that the nestled gage cutter elements 70 be positioned close enough to gage cutter elements 80 such that the corner cutting duty is divided to a substantial degree between these cutter elements. The required closeness is achieved where the nestled gage inserts 70 are mounted in cone cutter 14 adjacent to shoulder 50.

Referring again to FIG. 6, conventional bits having a comparatively large distance between gage inserts 100 and first inner row inserts 103 typically have required that the cutter include a relatively large number of gage inserts 100 in order to maintain gage and withstand the abrasion and sidewall forces imposed on the bit. It is known, however, that increased ROP in many formations is achieved by having relatively fewer cutter elements in a given bottom hole cutting row so that the force applied by the bit to the formation material is more concentrated than if the same force were to be divided among a larger number of cutter elements. Thus, the prior art bit 110 was again a compromise because of the requirement that a substantial number of gage inserts 100 be maintained on the bit in an effort to hold gage.

By contrast, and according to the present invention, because the sidewall cutting function has been divided between nestled gage inserts 70 and gage inserts 80, a more aggressive cutting structure may be employed by having a comparatively fewer number of gage inserts 80 as compared to the number of gage row inserts 100 of the prior art bit 110 shown in FIG. 6. In other words, because in the present invention nestled gage inserts 70 cut the sidewall of the borehole and are positioned in relative close proximity to gage inserts 80, gage inserts 80, which are not solely responsible for cutting sidewall or maintaining gage, may be fewer in number and may be further spaced so as to better concentrate the forces applied to the formation. Concentrating such forces tends to increase ROP in certain formations. Also, providing fewer gage cutter elements 80 on the gage row 80*a* increases the pitch between the cutter elements and the chordal penetration, chordal penetration being the maximum penetration of an insert into the formation before adjacent inserts in the same row contact the hole bottom. Increasing the chordal penetration allows the cutter elements to penetrate deeper into the formation, thus again tending to improve ROP. Increasing the pitch between gage row inserts 80 has the additional advantages that it provides greater space between the gage inserts 80 which results in improved cleaning of the inserts and enhances cutting removal from hole bottom by the drilling fluid.

Because of the placement of inserts 70 and 80 in the present invention, bit 10 may provide increased durability given that gage inserts 80 will not be subjected to as high an impact load from the sidewall 5 (as compared to gage inserts 100 of the prior art bit 110 of FIG. 6, for example) because a substantial portion of the impact loading imparted to bit 10 will be assumed by the nestled gage inserts 70. Also, gage inserts 80 are not as susceptible to wear and thermal fatigue as they would be if no nestled gage insert 70 was employed. Compared to conventional gage row inserts 100 in bits such as that shown in FIG. 6, gage row inserts 80 of the present invention are called upon to do substantially less work in cutting the borehole sidewall.

The work performed by a cutter element is proportional to the force applied to the formation by the cutter element multiplied by the distance that the cutter element travels while in contact with the formation, such distance generally referred to as the cutter element's "strike distance." In the present invention in which nestled gage inserts 70 are positioned on gage adjacent to shoulder 50 in close proximity to gage inserts 80, the effective or unassisted strike distance of gage inserts 80 is lessened due to the fact that nestled gage inserts 70 will assist in cutting the borehole sidewall and thus will reduce the distance that gage inserts 80 must cut unassisted. This results in less wear, thermal fatigue and breakage for gage inserts 80 relative to that experienced by conventional gage inserts 100 under the same conditions. The distance referred to as the "unassisted strike distance" is identified in FIG. 4 by the reference "USD." The closer nestled gage inserts 70 are mounted to gage inserts 80, the shorter the unassisted strike distance will be for gage inserts 80. Further, the more sidewall cutting duty which gage inserts 80 are relieved from performing by the assumption of that duty by nestled gage inserts 70, the less heat gage inserts 80 will be forced to dissipate. Reducing the heat load for gage inserts 80 (again compared, for example, to gage inserts 100 of the prior art bit of FIG. 6) decreases the possibility of heat-induced cutter element failure and thus increases bit life.

Referring again to FIG. 1, it is generally preferred that nestled gage row inserts 70 be circumferentially positioned at locations between each of the gage row inserts 80. Due to the strategic placement of nestled gage inserts 70 which relieves gage row inserts 80 from having to perform essentially all of the sidewall cutting, the pitch between gage inserts 80 may be increased as previously described in order to increase ROP. Additionally, with increased spacing between adjacent gage inserts 80 in row 80*a,* two or more nestled gage inserts 70 may be disposed between adjacent gage inserts 80. This further enhances the durability of bit 10 by providing a greater number of nestled gage inserts 70 adjacent to circumferential shoulder 50.

An additional advantage of dividing the borehole cutting function between nestled gage inserts 70 and gage inserts 80 is the fact that a greater number of inserts 70, 80 may be placed around the cone cutter 14 to maintain gage. Because nestled gage inserts 70 are not required to perform any substantial bottom hole cutting, the increase in number of inserts 70, 80 cutting to gage will not diminish or hinder ROP, but will only enhance bit 10's ability to maintain fill gage. At the same time, the invention allows relatively large diameter or large extension inserts to be employed as gage inserts 80 as is desirable for gouging and breaking up formation on the hole bottom. Consequently, in preferred embodiments of the invention, the ratio of the diameter of nestled gage inserts 70 to the diameter of gage inserts 80 is preferably not greater than 0.75. Presently, a still more preferred ratio of these diameters is within the range of 0.5 to 0.725.

Positioning inserts 70 and 80 in the manner previously described means that the cutting profiles of the inserts 70, 80, in many embodiments, will partially overlap each other when viewed in rotated profile as is best shown in FIGS. 4 or 9. Referring to FIG. 9, the extent of overlap is a function of the diameters of the inserts 70, 80, the proximity of inserts 70 to inserts 80, and the inserts' orientation, shape and extension from cone cutter 14. As used herein, the distance of overlap 91 is defined as the distance between parallel planes $P_3$ and $P_4$ shown in FIGS. 4 and 9. Plane $P_3$ is a plane that is parallel to the axis 74 of nestled gage insert 70 and that passes through the point of intersection between the cylindrical base portion of gage insert 80 and the land 78 of nestled gage insert 70. $P_4$ is a plane that is parallel to $P_3$ and that coincides with the edge of the cylindrical base portion of nestled gage row insert 70 that is closest to the bit axis. This definition applies to the embodiments shown in FIGS. 4 and 9.

The greater the overlap between cutting profiles of cutter elements 70, 80 means that inserts 70, 80 will share more of the sidewall cutting duties, while less overlap means that the gage inserts 80 will perform more sidewall cutting duty, while nestled gage inserts 70 will perform less sidewall cutting duty. Depending on the size and type of bit and the type of formation, the ratio of the distance of overlap to the diameter of the nestled gage inserts 70 is preferably greater than 0.40.

As those skilled in the art understand, the International Association of Drilling Contractors (IADC) has established a classification system for identifying bits that are suited for particular formations. According to this system, each bit presently falls within a particular three digit IADC classification, the first two digits of the classification representing, respectively, formation "series" and formation "type." A "series" designation of the numbers 1 through 3 designates steel tooth bits, while a "series" designation of 4 through 8 refers to tungsten carbide insert bits. According to the present classification system, each series 4 through 8 is further divided into four "types," designated as 1 through 4. TCI bits are currently being designed for use in significantly softer formations than when the current IADC classification system was established. Thus, as used herein, an IADC classification range of between "41–62" should be understood to mean bits having an IADC classification within series 4 (types 1–4), series 5 (types 1–4) or series 6 (type 1 or type 2) or within any later adopted IADC classification that describes TCI bits that are intended for use in formations softer than those for which bits of current series 6 (type 1 or 2) are intended.

In the present invention, because the corner cutting duty has been substantially divided between cutter elements 70 and gage cutter elements 80, it is generally desirable that cutter elements 80 extend further from cone 14 than elements 70 (relative to cone axis 22) so they can aggressively attack the borehole bottom given that a substantial portion of the sidewall cutting duty has been assumed by nestled gage cutter elements 70. This is especially true in bits designated to drill in soft through some medium hard formations, such as in steel tooth bits or in TCI insert bits having the IADC formation classifications of between 41–62. This difference in extensions may be described as a step distance 92, the "step distance" being the distance between planes $P_5$ and $P_6$ measured perpendicularly to cone axis 22 as shown in FIG. 9. Plane $P_5$ is a plane that is parallel to cone axis 22 and that intersects the radially outermost point on the cutting surface of nestled gage cutter element 70. Plane $P_6$ is a plane that is parallel to cone axis 22 and that intersects the radially outermost point on the cutting surface of gage cutter element 80. According to certain preferred embodiments of the invention, the ratio of the step distance to the extension of nestled gage cutter elements 70 above cone 14 should be not less than 0.8 for steel tooth bits and for TCI formation insert bits having IADC classification range of between 41–62. More preferably, this ratio should be greater than 1.0.

By dividing the borehole corner cutting duty between nestled gage cutter elements 70 and gage cutter elements 80, further and significant additional enhancements in bit durability, gage-maintaining ability, and ROP are made possible. Specifically, the materials that are used to form elements 70, 80 can be optimized to correspond to the demands of the particular application for which each element is intended. In addition, the elements can be selectively and variously coated with super abrasives, including polycrystalline diamond ("PCD") or cubic boron nitride ("PCBN") to further optimize their performance. These enhancements allow cutter elements 70, 80 to withstand particular loads and penetrate particular formations better than would be possible if the materials were not optimized as contemplated by this invention. Further material optimization is in turn made possible by the division of corner cutting duty.

The gage cutter element of a conventional bit is subjected to high wear loads from the contact with borehole wall, as well as high stresses due to bending and impact loads from contact with the borehole bottom. The high wear load can cause thermal fatigue, which initiates surface cracks on the cutter element. These cracks are further propagated by a mechanical fatigue mechanism that is caused by the cyclical bending stresses and/or impact loads applied to the cutter element. These result in chipping and, more severely, in catastrophic cutter element breakage and failure.

The nestled gage cutter elements 70 of the present invention are subjected to high wear loads, but are typically subjected to relatively low stress and impact loads, as their primary function consists of scraping or reaming the borehole wall. Even if thermal fatigue should occur, the potential of mechanically propagating these cracks and causing failure of a nestled gage cutter element 70 is much lower as compared, for example, to gage insert 100 of the conventional bit design of FIG. 6. Therefore, the present nestled gage cutter element 70 exhibits greater ability to retain its original geometry, thus improving the ROP potential and durability of the bit.

As explained in more detail below, the invention thus may include the use of a different grade of hard metal, such as cemented tungsten carbide, for nestled gage cutter elements 70 than that used for gage cutter elements 80. Similarly, the grade of cemented tungsten carbide used in gage cutter element 80 may differ from the grade used for inner row cutter elements 81, 82, 83, for example. Because gage inserts 80 must withstand some sidewall cutting duty, it is advantageous to provide them with a cutting surface that is more wear resistant than the material used in the inner rows. Additionally, the use of super abrasive coatings that differ in wear resistance and toughness, alone or in combination with hard metals, yields improvements in bit durability and penetration rates. Specific grades of cemented tungsten carbide and PCD or PCBN coatings can be selected depending primarily upon the characteristics of the formation and operational drilling practices to be encountered by bit 10.

Cemented tungsten carbide inserts formed of particular formulations of tungsten carbide and a cobalt binder (WC—Co) are successfully used in rock drilling and earth cutting applications due to the material's toughness and high wear resistance. Wear resistance can be determined by several ASTM standard test methods. It has been found that the ASTM B611 test correlates well with field performance in terms of relative insert wear life. It has further been found that the ASTM B771 test, which measures the fracture toughness (K1c) of cemented tungsten carbide material, correlates well with the insert breakage resistance in the field.

It is commonly known in the cemented tungsten carbide industry that the precise WC—Co composition can be varied to achieve a desired hardness and toughness. Usually, a carbide material with higher hardness indicates higher resistance to wear and also lower toughness or lower resistance to fracture. A carbide with higher fracture toughness normally has lower relative hardness and therefore lower resistance to wear. Therefore there is a trade-off in the material properties and grade selection, and the selection of a particular grade of carbide is based on the formation material that is expected to be encountered and the operational drilling practices to be employed.

As understood by those skilled in the art, the wear resistance of a particular cemented tungsten carbide cobalt binder formulation (WC—Co) is dependent upon the grain size of the tungsten carbide, as well as the percent, by weight, of cobalt that is mixed with the tungsten carbide. Although cobalt is the preferred binder metal, other binder metals, such as nickel and iron can be used advantageously. In general, for a particular weight percent of cobalt, the smaller the grain size of the tungsten carbide, the more wear resistant the material will be. Likewise, for a given grain size, the lower the weight percent of cobalt, the more wear resistant the material will be. Wear resistance is not the only design criteria for cutter elements 70, 80–83 however. Another trait critical to the usefulness of a cutter element is its fracture toughness, or ability to withstand impact loading. In contrast to wear resistance, the fracture toughness of the material is increased with larger grain size tungsten carbide and greater percent weight of cobalt. Thus, fracture toughness and wear resistance tend to be inversely related, as grain size changes that increase the wear resistance of a given sample will decrease its fracture toughness, and vice versa.

Due to irregular grain shapes, grain size variations and grain size distribution within a single grade of cemented tungsten carbide, the average grain size of a particular specimen can be subject to interpretation. Because for a fixed weight percent of cobalt the hardness of a specimen is inversely related to grain size, the specimen can be adequately defined in terms of its hardness and weight percent cobalt, without reference to its grain size. Therefore, in order to avoid potential confusion arising out of generally less precise measurements of grain size, cemented tungsten carbide specimens will hereinafter be defined in terms of hardness (measured in hardness Rockwell A (HRa)) and weight percent cobalt.

As used herein to compare or claim physical characteristics (such as wear resistance or hardness) of different cutter element materials, the term "differs" means that the value or magnitude of the characteristic being compared varies by an amount that is greater than that resulting from accepted variances or tolerances normally associated with the manufacturing processes that are used to formulate the raw materials and to process and form those materials into a cutter element. Thus, materials selected so as to have the same nominal hardness or the same nominal wear resistance will not "differ," as that term has thus been defined, even though various samples of the material, if measured, would vary about the nominal value by a small amount. By contrast, each of the grades of cemented tungsten carbide and PCD identified in the following Tables "differ" from each of the others in terms of hardness, wear resistance and fracture toughness.

There are today a number of commercially available cemented tungsten carbide grades that have differing, but in some cases overlapping, degrees of hardness, wear resistance, compressive strength and fracture toughness. One of the hardest and most wear resistant of these grades presently used in softer formation petroleum bits is a finer grained tungsten carbide grade having a nominal hardness of 90–91 HRa and a cobalt content of 6% by weight. Although wear resistance is an important quality for use in cutter elements, this carbide grade unfortunately has relatively low toughness or ability to withstand impact loads as is required for cutting the borehole bottom. Consequently, and referring momentarily to FIG. 6, in many prior art petroleum bits, cutter elements formed of this tungsten carbide grade have been limited to use as heel row inserts 102. Inner rows 103–105 of petroleum bits intended for use in softer formations have conventionally been formed of coarser grained tungsten carbide grades having nominal hardnesses in the range of 85.8–86.4 HRa, with cobalt contents of 14–16 percent by weight because of this material's ability to withstand impact loading. This formulation was employed despite the fact that this material has a relatively low wear resistance and despite the fact that, even in bottom hole cutting, significant wear can be experienced by inner row cutter elements 103–105 of conventional bits in particular formations.

As will be recognized, the choice of materials for prior art gage inserts 100 (FIG. 6) was a compromise. Although gage inserts 100 experienced both significant side wall and bottom hole cutting duty, they could not be made as wear resistant as desirable for side wall cutting, nor as tough as desired for bottom hole cutting. Making the gage insert 100 more wear resistant caused the insert to be less able to withstand the impact loading. Likewise, making the insert 100 tougher so as to enable it to withstand greater impact loading caused the insert to be less wear resistant. Because the choice of material for conventional gage inserts 100 was a compromise, the prior art petroleum bits designed for softer formations typically employed a medium grained cemented tungsten carbide having nominal hardness around 88.1–88.8 HRa with cobalt contents of 10–11% by weight.

The following table reflects the wear resistance and other mechanical properties of various commercially-available cemented tungsten carbide compositions:

TABLE 3

Properties of Typical Cemented Tungsten Carbide Insert Grades Used in Oil/Gas Drilling

| Cobalt content [wt. %] | Nominal Hardness [HRa] | Nominal Fracture Toughness K1c per ASTM test B771 [ksi√in] | Nominal Wear Resistance per ASTM test B611 [1000 rev/cc] |
|---|---|---|---|
| 6 | 90.8 | 10.8 | 10.0 |
| 11 | 89.4 | 11.0 | 6.1 |
| 11 | 88.8 | 12.5 | 4.1 |
| 10 | 88.1 | 13.2 | 3.8 |
| 12 | 87.4 | 14.1 | 3.2 |
| 16 | 87.3 | 13.7 | 2.6 |
| 14 | 86.4 | 16.8 | 2.0 |
| 16 | 85.8 | 17.0 | 1.9 |

Referring again to FIGS. 1–4, according to the present invention, it is desirable to form nestled gage cutter elements 70 from a very wear resistant carbide grade for most formations. Preferably nestled gage cutter elements 70 should be formed from a finer grained tungsten carbide grade having a nominal hardness in the range of approximately 88.1–90.8 HRa, with a cobalt content in the range of about 6–11 percent by weight. Suitable tungsten carbide grades include those having the following compositions:

TABLE 4

Properties of Grades of Cemented Tungsten Carbide Presently Preferred for Nestled Gage Cutter Element 70 for Oil/Gas Drilling

| Cobalt content [wt. %] | Nominal Hardness [HRa] | Nominal Fracture Toughness K1c per ASTM test B771 [ksiVin] | Nominal Wear Resistance per ASTM test B611 [1000 rev/cc] |
|---|---|---|---|
| 6 | 90.8 | 10.8 | 10.0 |
| 11 | 89.4 | 11.0 | 6.1 |
| 11 | 88.8 | 12.5 | 4.1 |
| 10 | 88.1 | 13.2 | 3.8 |

The tungsten carbide grades are listed from top to bottom in Table 4 above in order of decreasing wear resistance, but increasing fracture toughness.

In general, a harder grade of tungsten carbide with a lower cobalt content is less prone to thermal fatigue. The division of cutting duties provided by the present invention allows use of a nestled gage cutter element 70 that is a harder and more thermally stable than was possible for use as gage inserts 100 of conventional bits such as bit 110 of FIG. 6 in which gage inserts 100 had no substantial assistance in cutting the borehole sidewall. Thus positioning nestled gage inserts 70 as previously described and employing a relatively harder and more wear resistant grade of cemented tungsten carbide improves the durability and ROP potential of the bit.

At the same time, for gage cutter elements 80, which must withstand the bending moments and impact loading inherent in bottom hole drilling, it is preferred that a tougher and more impact resistant material be used, such as the tungsten carbide grades shown in the following table:

TABLE 5

Properties of Grades of Cemented Tungsten Carbide Presently Preferred for Gage Cutter Element 80 for Oil/Gas Drilling

| Cobalt content [wt. %] | Nominal Hardness [HRa] | Nominal Fracture Toughness K1c per ASTM test B771 [ksiVin] | Nominal Wear Resistance per ASTM test B611 [1000 rev/cc] |
|---|---|---|---|
| 11 | 89.4 | 11.0 | 6.1 |
| 11 | 88.8 | 12.5 | 4.1 |
| 10 | 88.1 | 13.2 | 3.8 |
| 12 | 87.4 | 14.1 | 3.2 |
| 16 | 87.3 | 13.7 | 2.6 |
| 14 | 86.4 | 16.8 | 2.0 |
| 16 | 85.8 | 17.0 | 1.9 |

With one exception, the tungsten carbide grades identified from top to bottom in Table 5 increase in fracture toughness and decrease in wear resistance (the grade having 12% cobalt and a nominal hardness of 87.4 HRa being tougher than the grade having 16% cobalt and a hardness of 87.3 HRa). Although an overlap exists in the preferred tungsten carbide grades for nestled gage cutter elements 70 and gage cutter elements 80, the gage cutter elements 80 will, in most all instances, be made of a tungsten carbide grade having a hardness that is less than that of the nestled gage cutter element 70. In most applications, cutter elements 80 will be of a material that is less wear resistant and more impact resistant. The relative difference in hardness between the nestled gage and gage cutter elements is dependent upon the application. For bit types designed for harder formations, the relative difference is less, and conversely, the difference becomes larger for soft formation bits.

Contrary to other prior art designs, the gage row cutter elements 80 are preferably made of a harder, more wear resistant material than the cutter elements in the inner rows 81–83. This allows the gage row cutter elements 80 to cut their proportional share of the borehole sidewall along with nestled gage cutter elements 70. Although certain prior art, such as U.S. Pat. No. 5,353,885, suggested that gage row cutter elements be made of the same tough tungsten carbide as the inner row cutter elements, this is believed undesirable in the present design because of the substantial sidewall cutting duty seen by gage row cutter elements 80, even though nestled gage cutter elements 70 also share the sidewall loading to a significant degree. Further, it is preferred in the present invention to also have heel row inserts on the heel surface to protect the cone cutter and the leg shirttail against erosion, and for reaming the borehole sidewall higher in the borehole where, by contrast, the '885 patent suggested that no heel row inserts be employed.

Because inner row cutter elements do not experience sidewall cutting duty, they do not have to be as wear resistant as gage cutter elements 80, and thus can be made of materials characterized as having greater toughness and ability to resist fracture. Thus, in comparison to gage row cutter elements 80, inner row cutter elements 81, 82, 83, are preferably tougher and more impact resistant. Grades of cemented tungsten carbide found suitable for use in inner rows 81*a*, 82*a*, 83*a* may be selected from the grades shown in Table 3 as dictated by the drilling application and formation characteristics.

It will be understood that the present invention is not limited by the cemented tungsten carbide grades identified in Tables 3–5 above. Typically in mining applications, it is preferred to use even harder grades, especially on inner rows. Also, the invention contemplates using harder, more wear resistant and/or tougher grades such as microgram and nanograin tungsten carbide composites as they are technically developed.

According to one preferred embodiment of the invention, nestled gage inserts 70 will be formed of a cemented tungsten carbide grade having a nominal hardness of 90.8 HRa and a cobalt content of 6% by weight and thus will have the wear resistance that previously was used in heel inserts 102 of the prior art (FIG. 6). At the same time, the gage inserts 80 will be formed of a tungsten carbide grade having a nominal hardness of 87.4 HRa and a cobalt content of 12% by weight, this grade having superior impact resistance to grades conventionally employed as gage inserts 100 in prior art bits (FIG. 6) while still being harder than typical grades employed on inner rows 103–105 of soft formation prior art bits. By optimizing the fracture toughness of gage inserts 80 for the particular formation to be drilled as contemplated by this invention, gage inserts 80 may have longer extensions or more aggressive cutting shapes, or both, so as to increase the ROP potential of the bit. Furthermore, by making gage row cutter elements 80 from a tougher material than has been conventionally used for gage row cutter elements, the number of gage cutter elements 80 can be decreased and the pitch or distance between adjacent cutter elements 80 can be increased (relative to the distance between adjacent prior art gage inserts 100 of FIG. 6). This can lead to improvements in ROP, as described previously. The longest strike distance on the borehole wall for the nestled gage cutter elements 70 occurs in large diameter, soft formation bit types with large offset. For those bits, a hard and wear-resistant tungsten carbide grade for the nestled gage cutter elements 70 is important, particularly in abrasive formations.

In addition, due to the increased gage durability resulting from the above-described cutter element placement and material optimization, the range of applications in which bit 10 of the present invention can be used is expanded. Since both ROP and bit durability are improved, it becomes economical to use the same bit type over a wider range of formations. A bit made in accordance to the present invention can be particularly designed to have sufficient strength/durability to enable it to drill harder or more abrasive sections of the borehole, and also to drill with competitive ROP in sections of the borehole where softer formations are encountered.

According to the present invention, substantial improvements in bit life and the ability of the bit to drill a full gage borehole are also afforded by employing cutter elements 60, 70, 80 that have coatings comprising differing grades of super abrasives. Such super abrasives may be applied to the cutting surfaces of all or preselected cutter elements 60, 70, 80. All cutter elements in a given row may not be required to have a coating of super abrasive to achieve the benefits of the present invention. In many instances, the desired improvements in wear resistance, bit life and durability may be achieved where only every other insert in the row, for example, includes the super abrasive coating.

Super abrasives are significantly harder than cemented tungsten carbide. Because of this substantial difference, the hardness of super abrasives is not usually expressed in terms of Rockwell A (HRa). As used herein, the term "super abrasive" means a material having a hardness of at least 2,700 Knoop (kg/mm$^2$). PCD grades have a hardness range of about 5,000–8,000 Knoop (kg/mm$^2$) while PCBN grades have hardnesses which fall within the range of about 2,700–3,500 Knoop (kg/mm$^2$). By way of comparison, the hardest grade of cemented tungsten carbide identified in Tables 3–5 has a hardness of about 1475 Knoop (kg/mm$^2$).

Certain methods of manufacturing cutter elements with PDC or PCBN coatings are well known. Examples of these methods are described, for example, in U.S. Pat. Nos. 4,604,106, 4,629,373, 4,694,918 and 4,811,801, the disclosures of which are all incorporated herein by this reference to the extent they are not inconsistent with the express teachings herein. Cutter elements with coatings of such super abrasives are commercially available from a number of suppliers including, for example, Smith Sii Megadiamond, Inc., General Electric Company, DeBeers Industrial Diamond Division, or Dennis Tool Company. Additional methods of applying super abrasive coatings also may be employed, such as the methods described in the co-pending U.S. patent application titled "Method for Forming a Polycrystalline Layer of Ultra Hard Material," Ser. No. 08/568,276, filed Dec. 6, 1995 and assigned to the assignee of the present invention, the entire disclosure of which is also incorporated herein by this reference to the extent not inconsistent with the express disclosure herein.

Typical PCD coated inserts of conventional bit designs are about 10 to 1000 times more wear resistant than cemented tungsten carbide depending, in part, on the test methods employed in making the comparison. The use of PCD coating on the inserts has, in some applications, significantly increased the ability of a bit to maintain full gage, and therefore has increased the useful service life of the bit. However, some limitations exist. Typical failure modes of PCD coated inserts of conventional designs are chipping and spalling of the diamond coating. These failure modes are primarily a result of cyclical loading, or what is characterized as a fatigue mechanism.

The fatigue life, or load cycles until failure, of a brittle material like a PCD coating is dependent on the magnitude of the load. The greater the load, the fewer cycles to failure. Conversely, if the load is decreased, the PCD coating will be able to withstand more load cycles before failure will occur.

Since the nestled gage and gage insets 70, 80 of the present invention cooperatively cut the corner of the borehole, the load (wear, frictional heat and impact) from the sidewall cutting action is shared between these inserts. Therefore, the magnitude of the resultant load applied to the individual gage inserts 80 is significantly less than the load that would otherwise be applied to a conventional gage insert such as insert 100 of the bit of FIG. 6 which alone was required to perform the corner cutting duty. Since the magnitude of the resultant force is reduced on gage inserts 80 in the present invention, the fatigue life, or cycles to failure of the PCD coated inserts is increased. This is an important performance improvement of the present invention resulting in improved durability of the gage (a more durable gage gives better ROP potential, maintains directional responsiveness during directional drilling, allows longer bearing life, etc.) and an increase in the useful service life of the bit. Also, it expands the application window of the bit to drill harder rock which previously could not be economically drilled due to limited fatigue life of the PCD on conventional gage row inserts.

Employing PCD coated inserts in the nestled gage row 70*a,* or gage row 80*a,* or both, has additional significant benefits over conventional bit designs, benefits arising from the superior wear resistance and thermal conductivity of PCD relative to tungsten carbide. PCD has about 5.4 times better thermal conductivity than tungsten carbide. Therefore, PCD conducts the frictional heat away from the cutting surfaces of cutter elements 70, 80 more efficiently than tungsten carbide, and thus helps prevent thermal fatigue or thermal degradation.

PCD starts degrading around 700° C. PCBN is thermally stable up to about 1300° C. In applications with extreme frictional heat from the cutting action, or/and in applications with high formation temperatures, such as drilling for geothermal resources, using PCBN coatings on the nestled gage row cutter elements 70 in a bit 10 of the present invention could perform better than PCD coatings.

The strength of PCD is primarily a function of diamond grain size distribution and diamond to diamond bonding. Depending upon the average size of the diamond grains, the range of grain sizes, and the distribution of the various grain sizes employed, the diamond coatings may be made so as to have differing functional properties. A PCD grade with optimized wear resistance will have a different diamond grain size distribution than a grade optimized for increased toughness.

The following table shows three categories of diamond coatings presently available from Smith Sii MegaDiamond Inc.

TABLE 6

| Designation | Average Diamond Grain Size Range (μm) | Rank Wear Resistance* | Rank Strength or Toughness* | Rank Thermal Stability* |
|---|---|---|---|---|
| D4 | <4 | 1 | 3 | 3 |
| D10 | 4–25 | 2 | 2 | 2 |
| D30 | >25 | 3 | 1 | 1 |

*A ranking of "1" being highest and "3" the lowest.

In abrasive formations, and particularly in medium and medium-to-hard abrasive formations, bit 10 of the present invention may include nestled gage inserts 70 having a cutting surface with a coating of super abrasives. For example, all or a selected number of nestled gage inserts 70 may be coated with a high wear resistant PCD grade having an average grain size range of less than 4 μm. Alternatively, depending upon the application, the PCD grade may be optimized for toughness, having an average grain size range of larger than 25 μm. These coatings will enable the coated nestled gage inserts 70 to withstand abrasion better than a tungsten carbide insert that does not include the super abrasive coating, and will permit the cutting structure of bit 10 to retain its original geometry longer and thus prevent reduced ROP and possibly a premature or unnecessary trip of the drill string. Given that nestled gage inserts 70 having such coating will be slower to wear, gage inserts 80 will be better protected from the sidewall loading that would otherwise be applied to them if nestled gage inserts 70 were to wear prematurely. Furthermore, with super abrasive coating on nestled gage inserts 70, gage inserts 80 may be made with longer extensions or with more aggressive cutting shapes, or both (leading to increased ROP potential) than would be possible if gage inserts 80 had to be configured to be able to bear increased sidewall cutting duty after nestled gage inserts 70 (without a super abrasive coating) wore due to abrasion and erosion.

In some soft or soft-to-medium hard abrasive formations, such as silts and sandstones, or in formations that create high thermal loads, such as claystones and limestones, conventional gage inserts 100 (FIG. 6) of cemented tungsten carbide have typically suffered from thermal fatigue, which has lead to subsequent gage insert breakage. According to the present invention, it is desirable in such formations to include a super abrasive coating on certain or all of the gage inserts 80 of bit 10 to resist abrasion, to maintain ROP, and to increase bit life. However, because gage inserts 80 in this configuration must be able to withstand some impact loading, the most wear resistant super abrasive material is generally not suitable, the application instead requiring a compromise in wear resistance and toughness. A suitable diamond coating for gage insert 80 in such an application would have relatively high toughness and relatively lower wear resistance and be made of a diamond grade with average grain size range larger than 25 μm. Nestled gage insert 70 in this example could be manufactured without a super abrasive coating, and preferably would be made of a finer grained cemented tungsten carbide grade having a nominal hardness of 90.8 HRa and a cobalt content of 6% by weight. Nestled gage inserts 70 of such a grade of tungsten carbide exhibit 2.5 times the nominal wear resistance and have significantly better thermal stability than inserts formed of a grade having a nominal hardness 88.8 HRa and cobalt content of about 11%, a typical grade used in conventional gage inserts 100 such as shown in FIG. 6. Where nestled gage inserts 70 are mounted between gage inserts 80 along circumferential shoulder 50 in the configuration shown in FIGS. 1–4, nestled gage inserts 70 of this example are believed capable of resisting wear and thermal loading in these formations even without a super abrasive coating.

The present invention also contemplates constructing bit 10 with preselected nestled gage inserts 70 and gage inserts 80 each having coatings of super abrasive material. In certain extremely hard and abrasive formations, both nestled gage inserts 70 and gage inserts 80 may include the same grade of PCD coating. For example, in such formations, the preselected inserts 70, 80 may include extremely wear resistant coatings such as a PCD grade having an average grain size range of less than 4 μm. In other formations that tend to cause high thermal loading on the inserts, such as soft and medium soft abrasive formations like silt, sandstone, limestone and shale, a coating of super abrasive material having high thermal stability is important. Accordingly, in such formations, it may be desirable to include coatings on inserts 70 and 80 that have greater thermal stability than the coating described above, such as coatings having an average grain size range of 4–25 μm.

In some formations, it is desirable to include superabrasive coating on inner row inserts 81, 82, 83. Because these inserts would not experience the sidewall cutting duty seen by inserts 70, 80, they could include tougher superabrasive coatings, such as PCD coatings having an average grain size greater than 25 μm. By contrast, inserts 60, 70 of the same bit may be more wear resistant, having PCD coatings with average grain size of less than 4 μm, while gage inserts 80 may be coated with a PCD grade representing more of a compromise in wear resistance and toughness, one having an average grain size of 4–25 μm.

In drilling directional wells through abrasive formations having varying compressive strengths (nonhomogeneous abrasive formations), it may again be desirable to include super abrasive coatings on both nestled gage inserts 70 and gage inserts 80. In such applications, gage inserts 80, for example, may be subjected to more severe impact loading than nestled gage inserts 70. In this instance, it would be desirable to include a tougher or more impact resistant coating on gage insert 80 than on nestled gage inserts 70. Accordingly, in such an application, it would be appropriate to employ a diamond coating on gage insert 80 having an average grain size range of greater than 25 μm, while nestled gage insert 70 may employ more wear resistant, but not as tough diamond coating, such as one having an average grain size within the range of 4–25 μm or smaller.

Optimization of cutter element materials in accordance with the present invention is further illustrated by the Examples set forth below. The Examples are illustrative, rather than inclusive, of certain of the various permutations that are considered to fall within the scope of the present invention.

EXAMPLE 1

A rolling cone cutter such as cutter 14 shown in FIGS. 1–4 is provided with inserts 60, 70, 80 and 81–83 consisting of uncoated tungsten carbide. The nestled gage inserts 70 have a nominal hardness in the range of 88.8 to at least 90.8 HRa and cobalt content in the range of about 11 to about 6 weight percent, while the gage inserts 80 have a nominal hardness in the range of 85.8 to 88.8 HRa and cobalt content in the range of about 16 to about 10 weight percent. Comparing the nominal wear resistances of a cemented tungsten carbide grade having a nominal hardness of 89.4 HRa and one having a nominal hardness of 88.8 HRa as might be employed in the nestled gage row 70*a* and gage row 80*a*, respectively, in previous example, the wear resistance of nestled gage element 70 would exceed that of gage element 80 by about 48%. A most preferred embodiment of this example, however, has nestled gage inserts 70 in the gage row 70*a* with a nominal hardness of 90.8 HRa and cobalt content of about 6 percent, and gage inserts 80 in the gage row 80*a* with a nominal hardness of 87.4 HRa and cobalt content of about 12 percent, such that nestled gage inserts 70 are more than three times as wear resistant as gage inserts 80, but where gage inserts 80 are more than 30% tougher than nestled gage inserts 70. In this example, heel inserts 60 have a nominal hardness of 90.8 HRa, while inner row inserts 81–83 have a nominal hardness of 86.4 HRa.

EXAMPLE 2

A rolling cone cutter such as cutter 14 as shown in FIGS. 1–4 is provided with PCD-coated heel inserts 60 and nestled gage inserts 70, and with gage inserts 80 and inner row inserts 81–83 consisting of uncoated tungsten carbide. The coating on inserts 60 and 70 may be any suitable PCD coating, while the gage inserts 80 and inner row inserts 81–83 have a nominal hardness in the range of 85.8 to 88.8 HRa and cobalt content in the range of about 16 to about 10 weight percent. The most preferred embodiment of this example has gage inserts 80 with a nominal hardness of 87.4 to 88.1 HRa and cobalt content in the range of about 12 to about 10 weight percent, and inner row inserts 81–83 having a nominal hardness of 86.4–85.8 and cobalt content in the range of about 14–16 weight percent.

EXAMPLE 3

A rolling cone cutter such as cutter 14 as shown in FIGS. 1–4 is provided with PCD-coated nestled gage inserts 70 and gage inserts 80. The coating on the nestled gage inserts 70 or gage inserts 80 may be any suitable PCD coating. In a preferred embodiment of this example, the coating on the nestled gage inserts 70 is optimed for wear resistance and has an average grain size range of less than or equal to 25 $\mu$m. The PCD coating on the gage inserts 80 is optimized for toughness and preferably has an average grain size range of greater than 25 $\mu$m. Inner row inserts 81–83 may be uncoated tungsten carbide, or may be coated with PCD having an average grain size greater than 25 $\mu$m and preferably greater than the average grain size employed on gage insert 80.

EXAMPLE 4

A rolling cone cutter such as cutter 14 as shown in FIGS. 1–4 is provided with nestled gage inserts 70 of uncoated tungsten carbide and gage inserts 80 coated with a suitable PCD coating. The nestled gage inserts 70 have a nominal hardness in the range of 89.4 to 90.8 HRa and cobalt content in the range of about 11 to about 6 weight percent. The most preferred embodiment of this example has nestled gage inserts 70 with a nominal hardness of 90.8 HRa and cobalt content about 6 percent and gage inserts 80 having a coating optimized for toughness and preferably having an average grain size range of greater than 25 $\mu$m.

Figure 8A:
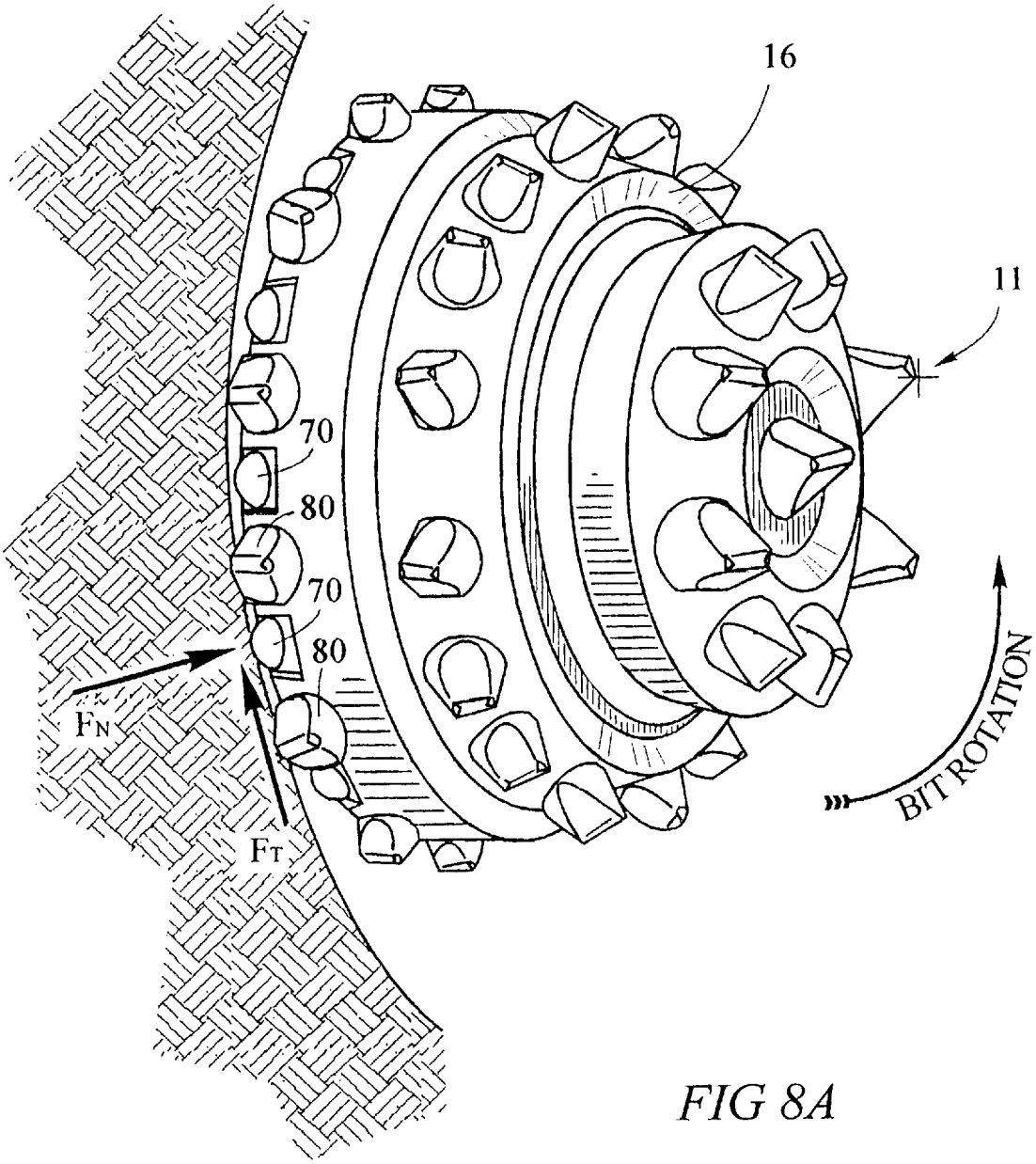
FIG. 8A is a perspective view of one cone cutter of the bit of FIG. 1 as viewed along the bit axis from the cutting end of the bit.
Figure 8B:
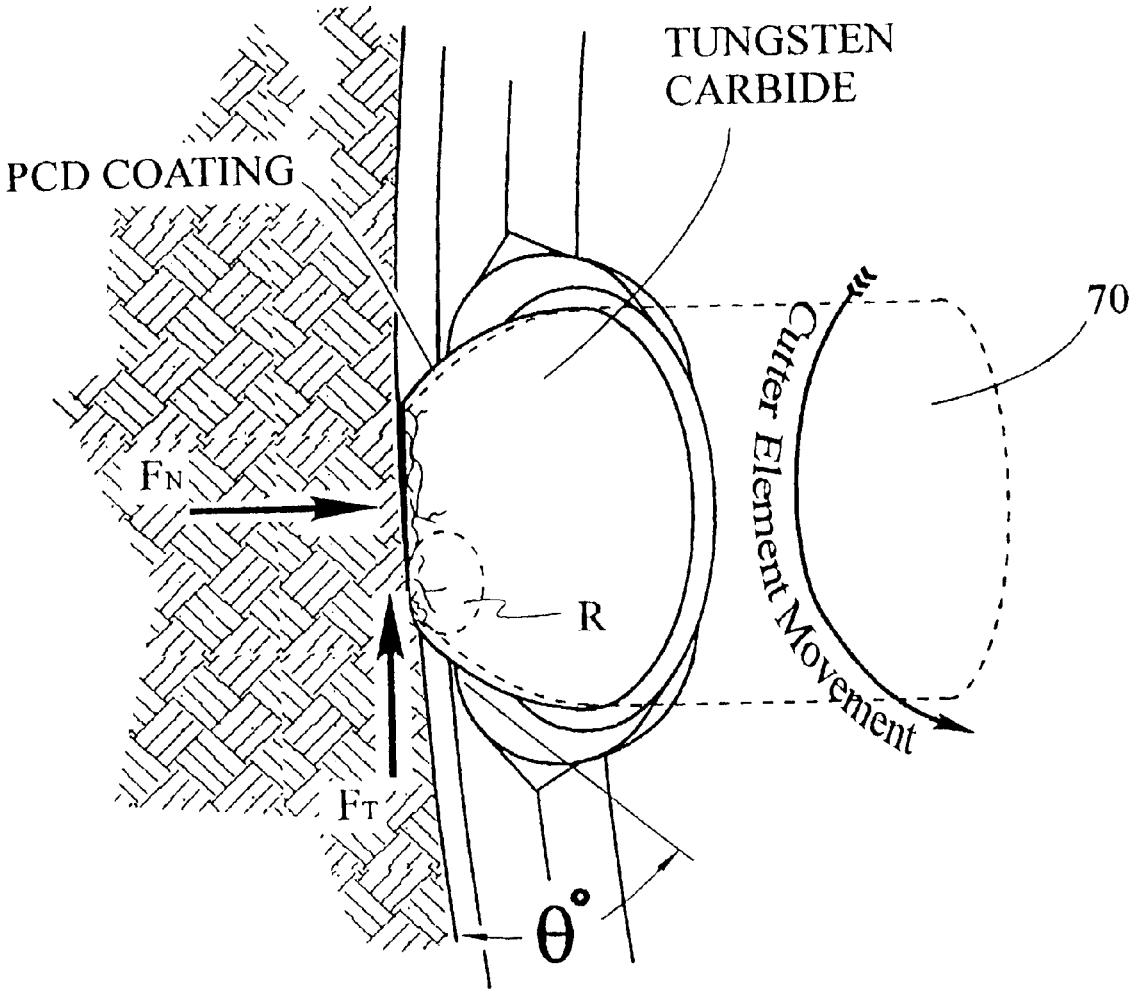
FIG. 8B is an enlarged view of a cutter element of the cone cutter of FIG. 8A showing various forces imparted to the cutter element while drilling.

In addition or as an alternative to the material enhancements described above, in accordance with the present invention, it is preferred that nestled gage insert 70 be optimized in terms of geometry so as to engage the formation material with a negative back rake. Referring to FIGS. 8A and 8B, a cone of bit 10 is shown as viewed from the bottom of the borehole looking along the bit axis 11. The cone, such as cone 16 shown in FIG. 1, includes nestled gage insert 70 having hemispherical cutting surfaces, and chisel shaped gage inserts 80 such as shown in rotated profile in FIG. 4. As best shown in FIG. 8B, nestled gage insert 70 at its radially outermost point is subjected to the forces imparted by the borehole wall, namely the normal force $F_N$ and the tangential force $F_T$. The tangential force is significant from a bit design and durability standpoint, the tangential force being the sum of the forces resisting removal of the formation material and the frictional force acting against the cutting surface. The cutting surface engages the formation material at a negative rake angle equal to 0 which is measured between a borehole sidewall and a line drawn tangent to the cutting surface at the point where the cutting surface engages the formation material. In the present invention, it is preferred that nestled gage insert 70 be positioned and that its cutting surface be shaped such that the cutting surface engages the formation material with a negative back rake throughout its cyclic engagement with the formation material. The hemispherical cutting surface shown in FIGS. 4 and 8B is one means to ensure the desired rake angle.

Referring still to FIG. 8B, even after some wear or chipping occurs to the PCD layer at its outermost portion, there remains a substantial mass of tungsten carbide substrate directly behind the portion of the PCD coating to which the tangential force $F_T$is most directly applied, that region shown generally as region "R." Accordingly, the PCD coating on cutter element 70 is more resistive to chipping, spalling and delamination as compared to cutter elements that are shaped and positioned in the cone with positive back rake in a manner that does not offer substantial support to the diamond layer to permit it to resist the tangential force.

Although the invention has been described with reference to the currently-preferred and commercially available grades or classifications tungsten carbide and PDC coatings, it should be understood that the substantial benefits provided by the invention may be obtained using any of a number of other classes or grades of carbide and PCD coatings. What is important to the invention is the ability to vary the wear resistance, thermal stability and toughness of cutter elements 70, 80 by employing carbide cutter elements and diamond coatings having differing compositions. Advantageously then, the principles of the present invention may be applied using even more wear resistant or tougher tungsten carbide, PCD or PCBN surfaces as they become commercially available in the future.

Figure 10:
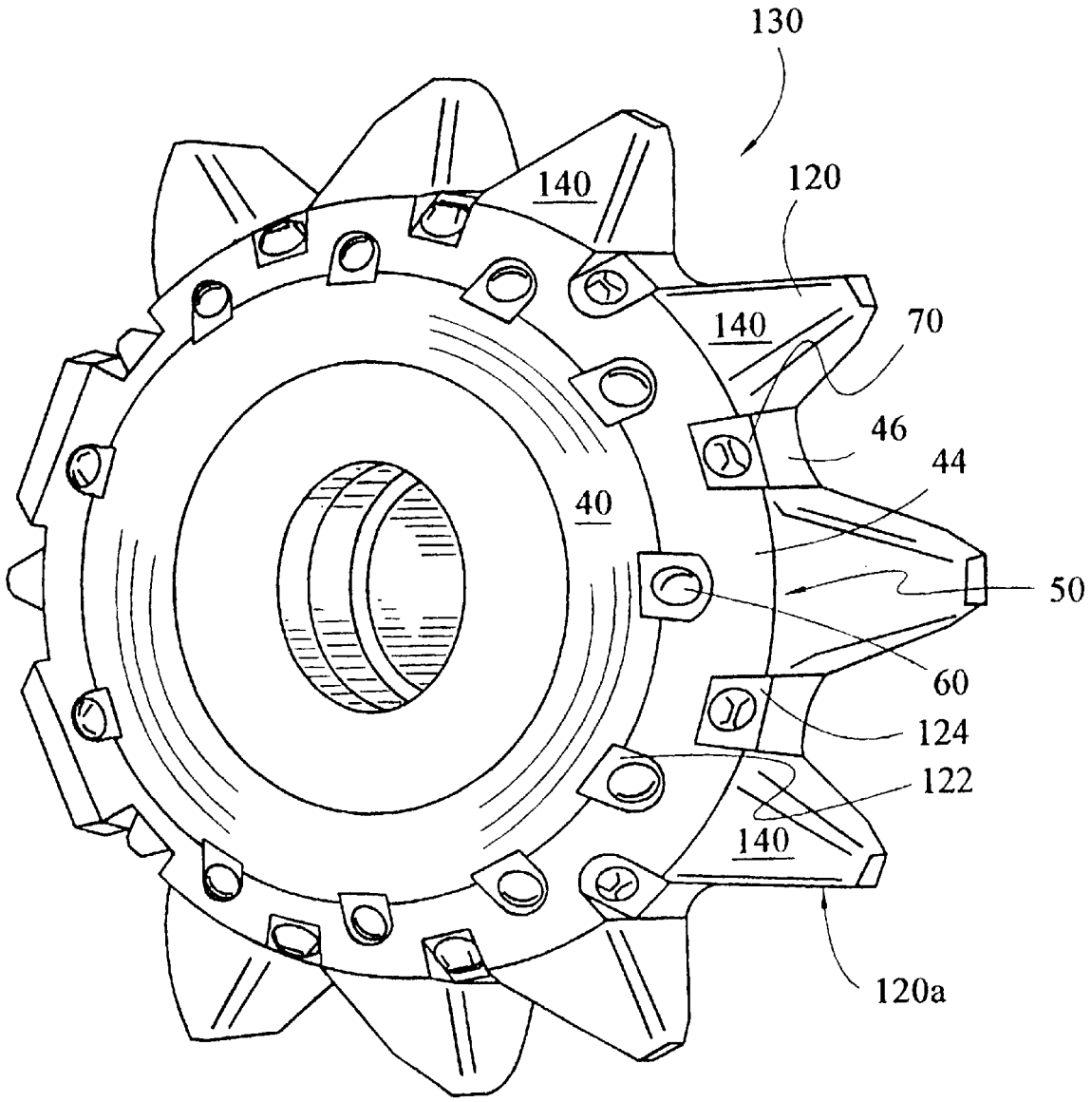
FIG. 10 is a perspective view of a steel tooth cone cutter showing an alternative embodiment of the present invention.
Figure 11:
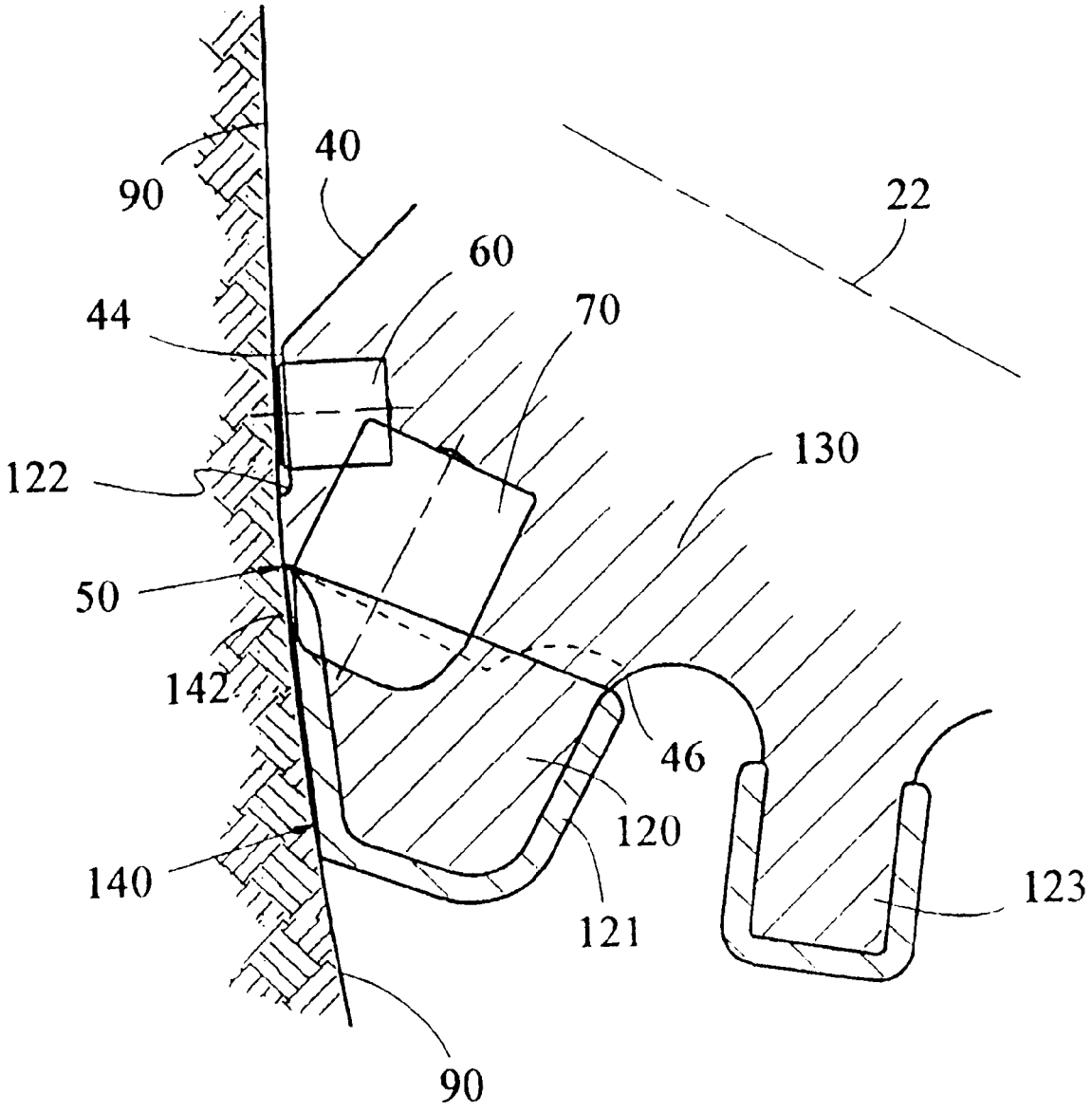
FIG. 11 is an enlarged cross-sectional view similar to FIG. 4, showing a portion of the cutting structure of the steel tooth cutter shown in FIG. 10.

The present invention may be employed in steel tooth bits as well as TCI bits as will be understood with reference to FIGS. 10 and 11. As shown, a steel tooth cone 130 is adapted for attachment to a bit body 12 in a like manner as previously described with reference to cones 14–16. When the invention is employed in a steel tooth bit, the bit would include a plurality of cutters such as rolling cone cutter 130. Cutter 130 includes a backface 40, a generally conical surface 46 and a heel surface 44 which is formed between conical surface 46 and backface 40, all as previously described with reference to the TCI bit shown in FIGS. 1–4. Similarly, steel tooth cutter 130 includes heel row inserts 60 embedded within heel surface 44, and nestled gage row cutter elements such as nestled gage inserts 70 disposed adjacent to the circumferential shoulder 50 as previously defined. Although depicted as inserts, nestled gage cutter elements 70 may likewise be steel teeth or some other type of cutter element. Relief 122 is formed in heel surface 44 about each heel insert 60. Similarly, relief 124 is formed about nestled gage cutter elements 70, relieved areas 122, 124 being provided as lands for proper mounting and orientation of inserts 60, 70. In addition to inserts 60, 70, steel tooth cutter 130 includes a plurality of gage row cutter elements 120 generally formed as radially-extending teeth and inner rows of teeth 123. Steel teeth 120, 123 include an outer layer or layers of hardfacing 121 to improve durability of cutter elements 120.

As shown in FIG. 11, steel teeth 120 have gage facing cutting surfaces 140 that are "on gage" and generally conform to the gage curve 90. In particular, portion 142 of gage facing surface 140 should extend to full gage. In this configuration, nestled gage inserts 70, which also extend to full gage, cooperatively cut the borehole corner with steel teeth 120 of the gage row, teeth 120 being primarily responsible for cutting the borehole bottom and with nestled gage inserts 70 and steel teeth 120 substantially sharing the sidewall cutting duty. Preferably, gage facing surface 140 of teeth 120 is hardfaced with a material that is more wear resistant than the hardfacing used on inner row teeth 123 which are subjected to more bottom hole cutting than gage teeth 120. The surfaces of gage teeth 120 other than gage facing surfaces 140 may likewise be hardfaced with material that is less wear resistant but tougher than the hardfacing used on gage facing surfaces 140.

Steel tooth cutters such as cutter 130 have particular application in relatively soft formation materials and are preferred over TCI bits in many applications. Nevertheless, even in relatively soft formations, in prior art bits in which the gage row cutter elements consisted of steel teeth, the substantial sidewall cutting that must be performed by such steel teeth may cause the teeth to wear to such a degree that the bit becomes undersized and cannot maintain gage. Additionally, because the formation material cut by even a steel tooth bit frequently includes strata having various degrees of hardness and abrasiveness, providing a bit having inserts 70 on gage between adjacent gage steel teeth 120 as shown in FIGS. 10 and 11 provides a division of corner cutting duty and permits the bit to withstand very abrasive formations and to prevent premature bit wear. Other benefits and advantages of the present invention that were previously described with reference to a TCI bit apply equally to steel tooth bits, including the advantages of employing materials of differing hardness and toughness for nestled gage inserts 70 and gage steel teeth 120. Optimization of cutter element materials in steel tooth bits is further described by the illustrative examples set forth below.

EXAMPLE 5

A steel tooth bit having a cone cutter 130 such as shown in FIG. 11 is provided with nestled gage row inserts 70 of tungsten carbide with a nominal hardness within the range of 88.1–90.8 HRa and cobalt content in the range of about 11 to about 6% by weight. Within this range, it is preferred that nestled gage inserts 70 have a nominal hardness within the range of 89.4 to 90.8 HRa. Gage row steel teeth 120 include an outer layer of conventional wear resistant hardfacing material 121 such as tungsten carbide and metallic binder compositions to improve their durability.

EXAMPLE 6

A steel tooth bit having a cone cutter 130 such as shown in FIG. 11 is provided with tungsten carbide nestled gage row inserts 70 having a coating of super abrasives of PCD or PCBN. Where PCD is employed, the PCD has an average grain size that is not greater than 25 $\mu$m. Steel teeth 120 include a layer of conventional hardfacing material 121.

Referring again to FIGS. 1–4, in many formations and drilling applications, it is preferred that nestled gage inserts 70 be nonshearing cutter elements that have rounded or contoured cutting surfaces rather than cutting surfaces that present sharp edges to the formation material, such as surfaces that include regions which intersect in small radii. As best shown in FIG. 4, a preferred insert 70 includes a generally hemispherical cutting surface 170 attached to cylindrical base portion 172. Examples of other cutter elements having the desired rounded, nonshearing cutting surfaces for use in nestled gage row 70*a* are shown and described in U.S. Pat. Nos. 5,172,777 5,415,244; 5,421,424; and 5,322,138, the disclosures of which are incorporated by this reference to the extent not otherwise inconsistent herewith. Although less force is required to cut through certain formations using a cutting structure having shearing cutter elements, a shearing cutter element is more susceptible to being damaged or dulled from impact loading than a cutter element having a rounded or contoured cutting surface that does not rely upon a sharp edge surface for cutting. Consequently, although shear cutter elements in the position of the nestled gage inserts 70 may provide more efficient cutting for a time and may be desired in certain applications, the shear cutter elements do not have the durability that is provided by a nonshearing nestled gage inserts 70.

Preferred embodiments of the present invention thus employ "sculptured" or "continuously contoured" cutter elements in the position of nestled gage inserts 70. As used herein, the terms "continuously contoured" or "sculptured" refer to cutting surfaces that can be described as continuously curved surfaces wherein relatively small radii (typically less than 0.080 inches) are not used to break sharp edges or round-off transitions between adjacent distinct surfaces as is typical with many conventionally designed cutter elements. Eliminating sharp breaks in curvature between adjacent regions on the cutting surface lessens the undesirable areas of high stress concentration which can contribute to or cause premature cutter element breakage. Thus, cutting surfaces that are "continuously contoured" or "sculptured" include cutting surfaces that are hemispherical, as well as others that may include a rounded or contoured crest, the crest being either perpendicular to the axis of the cutter element or inclined with respect a plane that is perpendicular to that axis.

Cutting surfaces that are continuously contoured present a very durable cutting surface that is not as susceptible to premature wear or breakage as a sharp chisel or scraper inserts, such as that shown in U.S. Pat. No. 5,351,768. As compared to the scraper insert of the '768 patent, the rounded or sculptured shape of the cutting surface on inserts 70, having large corner radii, distribute the contact force from the hole wall evenly on the cutting surface so as to reduce contract stress and resultant wear. Relative to scraper insert of the '768 patent, the geometry of the nestled gage insert 70 of the present invention creates a relatively large contact area with the borehole, leading to less contact stress and less heat generation caused by friction from the borehole wall. Decreased heat generation leads to smaller temperature differences between portions of the insert which, in turn, reduces the possibility of heat checking and subsequent breakage.

The sculptured or continuously contoured shape of the nestled gage inserts 70 of the present invention also provides a superior substrate for supporting PCD or other superabrasive materials. Bonding on surfaces having small radii are inherently susceptible to delamination between the diamond and the carbide substrate, as well as chipping or spalling within the diamond layer itself. The continuously contoured shape of the nestled gage inserts 70 thus provide a superior bond and does not include the inherent discontinuity of a diamond/tungsten carbide intersection as presented by the scraper insert described in the '768 patent.

Significantly, the present invention with its rounded or continuously contoured nestled gage cutter elements 70, engages the borehole wall with a negative rake angle. Although less aggressive than the positive rake angle taught by the '768 patent, the present inserts are more durable because of their negative rake angles. Furthermore, because of their rounded or contoured shape, a substantial mass of tungsten carbide supports, or "backs up" the diamond layer as it is being attacked by the tangential forces imposed on the cutter element by the borehole wall. Thus, although diamond coating may wear or be chipped at the most exposed portion of the cutter element 70, as such wear occurs, an intact or virgin area of the diamond coating will begin cutting the borehole sidewall and still be supported by a substantial volume of tungsten carbide behind it.

Figure 12:
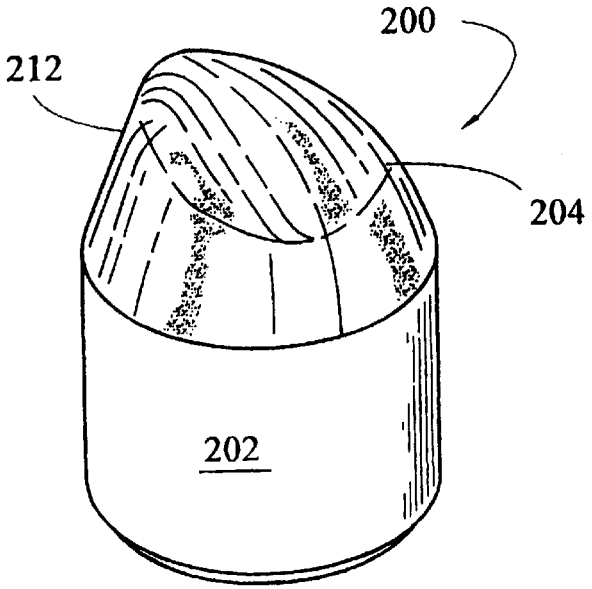
FIG. 12 is a perspective view of an alternative insert for use as a nestled gage or gage insert in the present invention.
Figure 13B:
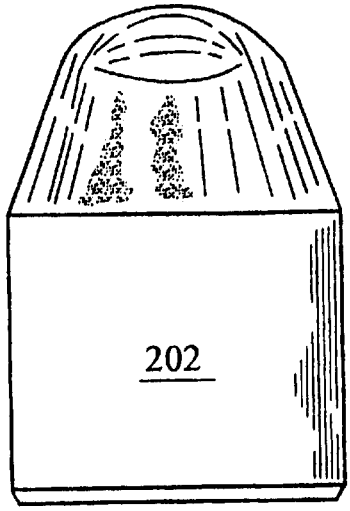
FIGS. 13A and 13B are a side elevational views of the insert shown in FIG. 12.
Figure 14:
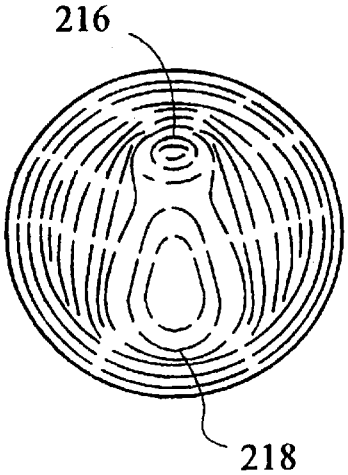
FIG. 14 is a top view of the insert shown in FIG. 12.
Figure 13A:
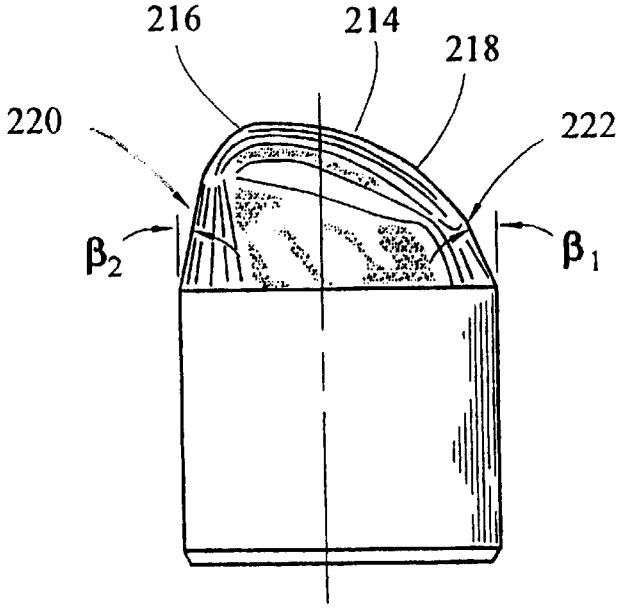

Another preferred shape of insert for use in nestled gage row 70*a* or gage row 80*a* is shown in FIGS. 12–14. As shown, nestled gage insert 200 includes a generally cylindrical base portion 202 and a cutting portion 204 attached thereto. Cylindrical base portion 202 is mounted in cones 14–16 in nestled gage rows 70*a* as previously described with reference to nestled gage inserts 70 in FIGS. 1–4. The cutting portion 204 includes a continuously contoured cutting surface 212 formed with no sharp bends or changes in radius (sometimes referred to as "blend radii"). Insert 200 thus described is very durable. Cutting surface 212 includes a generally wedge shaped crest 214 having ends 216, 218. As shown, crest 214 is inclined with respect to a plane perpendicular to the axis of the cutter element, the crest inclining from end 218 toward end 216. As shown in the overhead view of FIG. 14, crest 214 is wider at end 218 than at end 216. Cutting surface 212 further includes the side surfaces 220, 222 which extend between the cylindrical base 202 and crest 214. Side surface 222 is more steeply inclined between base 202 and crest 214 than is side surface 220, angles β1 and β2 as shown in FIG. 13A being preferably 25 and 12 degrees respectively. The remaining portions of cutting surface 212 blend with wedge shaped crest 214 and side surfaces 220, 222 so that the cutting surface is continuously contoured. Like a nestled gage insert having a hemispherical cutting surface like insert 70 shown in FIGS. 4 and 8B, insert 200 is positioned within the rolling cone so as to engage the borehole wall with a negative rake angle.

To further increase wear resistance, all or selected inserts 200 in nestled gage row 70*a* preferably include a coating of PCD or other super abrasive over the entire cutting surface 212 to substantially increase the cutter element's wear resistance over a comparable cutter of uncoated tungsten carbide. PDC coatings are especially durable when applied to inserts such as insert 200 which are shaped to have rounded or spherical surfaces or other continuously contoured shapes having only gradual changes in curvature. Also, by covering the entire cutting surface 212 with a coating of super abrasive, the coating is more resistant to impact damage, such as chipping or spalling, and to delamination than if only a portion of the cutting surface were coated.

Figure 17:
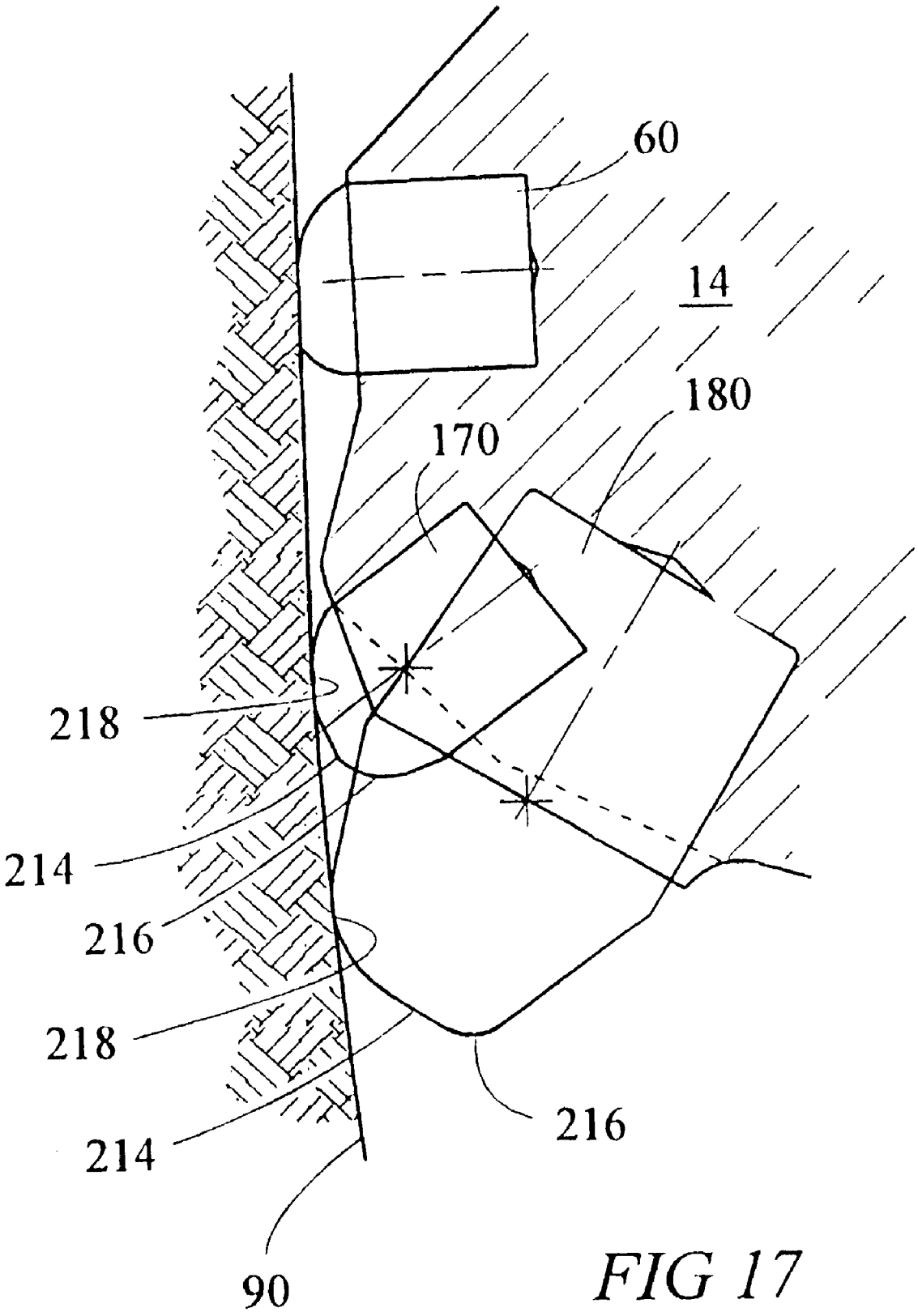
FIG. 17 is a view similar to FIG. 4 showing another alternative embodiment of the invention.

Optimizing the placement and material combinations for nestled gage inserts 70 and gage inserts 80 allows the use of more aggressive cutting shapes in nestled gage row 70*a* and in gage row 80*a* leading to increased ROP potential. Specifically, it is advantageous in certain formations and drilling applications to employ chisel-shaped cutter elements in one or both of nestled gage row 70*a* and gage row 80*a*. Preferred chisel cutter shapes include those shown and described in U.S. Pat. Nos. 5,172,777, 5,322,138. A chisel insert presently-preferred for use in bit 10 of the present invention is shown in FIG. 17. As shown, both nestled gage insert 170 and gage insert 180 are chisel inserts having continuously contoured cutting surfaces, and are configured like insert 200 described above with reference to FIGS. 12–14. Inserts 170, 180 include crests 214 and are oriented such that the crests 214 are substantially parallel to cone axis 22 and so that wider ends 218 of the crests extend to cut full gage as previously defined.

The cutting surfaces of these inserts 170, 180 may be formed different grades of cemented tungsten carbide or may have super abrasive coatings in various combinations, all as previously described above. In most instances, nestled gage insert 170 will be more wear-resistant than gage insert 180. Where super abrasive coatings are applied, it is preferred that the entire cutting portion (i.e. that portion extending beyond the cylindrical base portion) of the insert 170, 180 will be coated.

EXAMPLE 7

A particularly desirable combination employing chisel inserts in rows 70*a* and 80*a* include nestled gage insert 170 having a PCD coating with an average grain size of less than or equal to 25 μm and a gage insert 180 of cemented tungsten carbide having a nominal hardness of 88.1 HRa. Where greater wear-resistance (as compared to cemented tungsten carbide) is desired for gage row 80*a,* insert 180 shown in FIG. 17 may instead be coated with a PCD coating such as one having an average grain size greater than 25 μm. From the preceding description, it will be apparent to those skilled in the art that a variety of other combinations of tungsten carbide grades and super abrasive coatings may be employed advantageously depending upon the particular formation being drilled and drilling application being applied.

Figure 15:
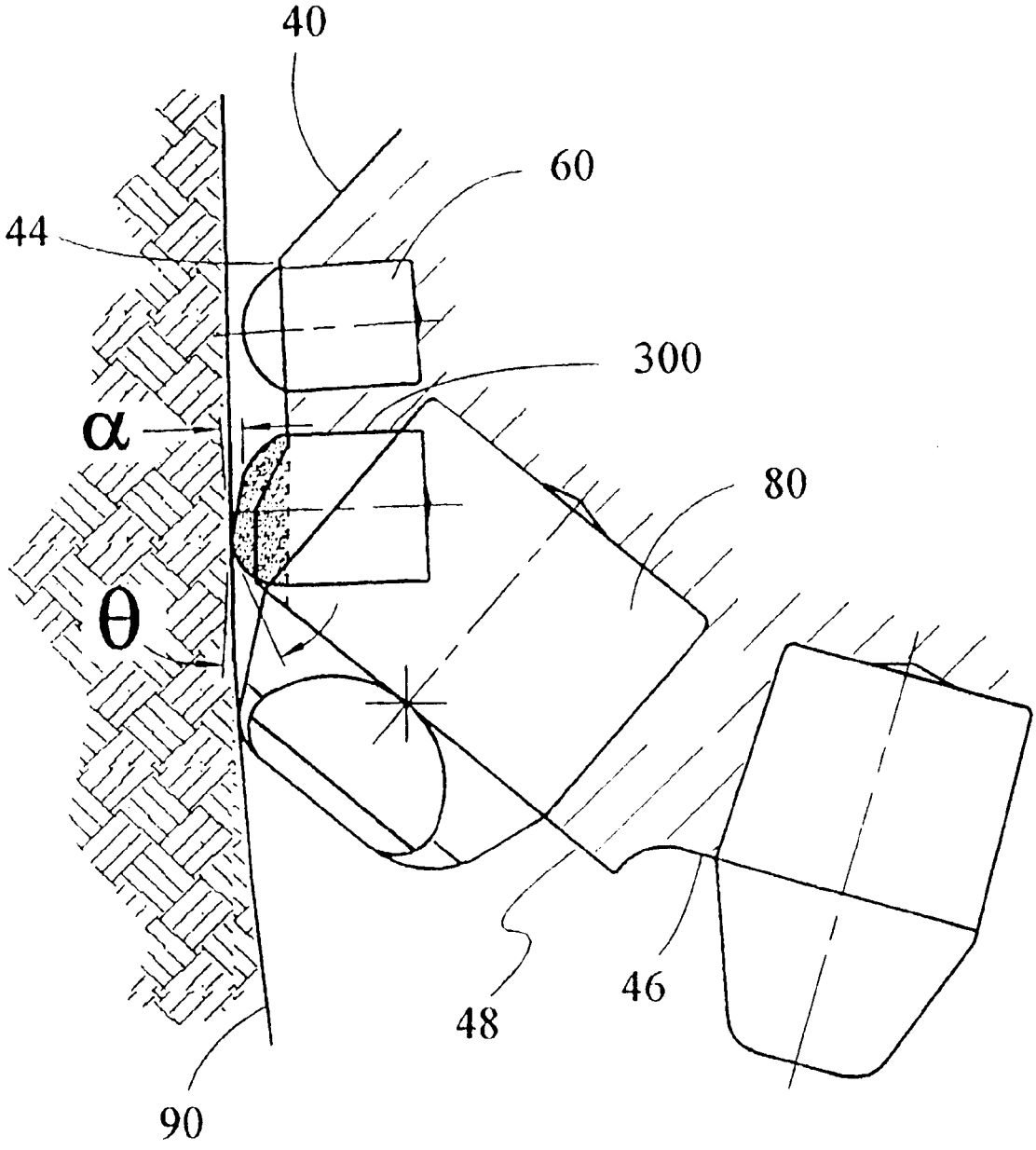
FIG. 15 is a view similar to FIG. 4 showing another alternative embodiment of the invention.
Figure 16:
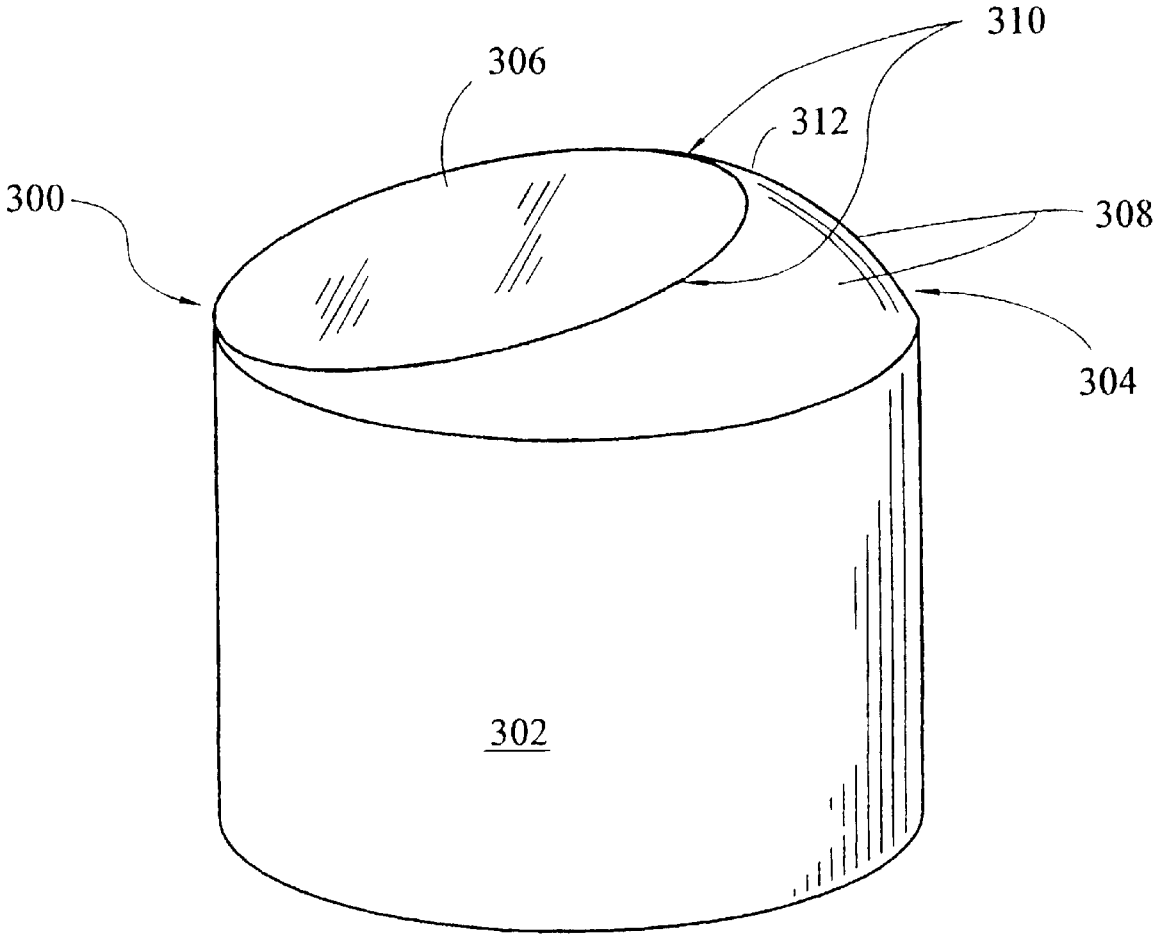
FIG. 16 is an enlarged perspective view of the nestled gage insert shown in FIG. 15.

In certain formations, a nestled gage cutter element configured to shear the formation may be desirable despite its inherent susceptibility to becoming dull or breaking more quickly than a non-shearing cutter element. Referring to FIGS. 15 and 16, there is shown a nestled gage insert 300 generally comprising cylindrical base portion 302 and cutting portion 304. Cutting portion 304 comprises a planar surface 306 and a non-planar transition surface 308 which intersects surface 306 to form an arcuate cutting edge 310. It is preferred that non-planar transition surface 308 be continuously contoured and include a super abrasive coating, such as PDC coating 312, best shown in FIG. 16. Planar surface 306 is preferably formed of a very wear resistant tungsten carbide material, such as that having a nominal hardness of 88.8 HRa or greater and is uncoated, except along its periphery. The PDC coating on surface 308 will preferably have an average diamond grain size of greater than 25 μm to provide relatively high thermal stability and toughness compared to other PDC coatings, although, depending upon the formation and drilling application, other diamond or PCBN super abrasive coatings may be employed.

As best shown in FIG. 16, transition surface 308 is a partially spherical surface. Insert 300 is best formed from an insert such as insert 70 of FIG. 4 which includes a hemispherical cutting surface 170. A portion of the hemispherical top is then removed by grinding the insert or by conventional electric-discharge machining (EDM) processes to form planar surface 306 having the desired inclination. Arcuate cutting edge 310 is formed at the outermost edge of planar surface 306.

In the embodiment shown in FIG. 15, gage insert 80 may be formed of a tough grade of cemented tungsten carbide, such as that having a nominal hardness of 87.4 HRa or less. Alternatively, gage insert 80 may include a coating of super abrasive such as PDC having an average grain size greater than 25 μm. As described previously, nestled gage insert 300 will assist gage insert 80 in forming the borehole corner and will primarily act against the borehole sidewall. This reduces the sidewall cutting duty of gage insert 80 thus relieving it of some degree of abrasive wear and side impact loading.

Referring to FIG. 15, insert 300 is shown oriented such that non planar transition surface 308 creates a negative rake angle θ as measured between transition surface 308 and the formation material. It further defines a relief angle α between planar surface 306 and the formation. Securing cutting elements 300 within cone cutter 14 in a position different than that shown in FIG. 15 by rotating cutter element 300 about its axis will vary the relief angle α from that depicted in FIG. 15. Rake angle *f* will also change if transition surface 308 includes change in curvature, but will remain negative so as to provide improved durability and enhanced support for the PCD coating as previously described with reference to FIGS. 8A and 8B. In any event, by varying rake angles θ and relief angle α by rotating element 300 about its axis, a more or less aggressive cutting structure may be created as may be desirable for certain formations. In certain instances, such as where drilling through formations with strata of differing degrees of hardness, it may be desirable to include nestled gage row 70*a* having both shearing and nonshearing cutter elements. For example, bit 10 may be constructed with a nestled gage row 70*a* having nestled gage cutters 200 and 300 in alternating positions.

While various preferred embodiments of the invention have been shown and described, modifications thereof can be made by one skilled in the art without departing from the spirit and teachings of the invention. The embodiments described herein are exemplary only, and are not limiting. Many variations and modifications of the invention and apparatus disclosed herein are possible and are within the scope of the invention. Accordingly, the scope of protection is not limited by the description set out above, but is only limited by the claims which follow, that scope including all equivalents of the subject matter of the claims.

What is claimed is:

1. An earth-boring bit having a nominal gage diameter for drilling a borehole, the bit comprising:

a bit body having a bit axis;

at least one rolling cone cutter rotatably mounted on said bit body and having a generally conical surface and an adjacent heel surface that intersect in a circumferential shoulder;

a plurality of nestled gage cutter elements secured to said cone cutter in a first circumferential row adjacent to said shoulder, said plurality of nestled gage cutter elements having cutting surfaces of a first preselected nominal wear resistance that extend to full gage and engage the borehole wall with a negative rake angle;

a plurality of gage cutter elements secured to said cone cutter on said conical surface in a second circumferential row that is spaced apart from said first row, said plurality of gage cutter elements having cutting surfaces of a second preselected nominal wear resistance that extend to full gage;

said plurality of nestled gage cutter elements and said plurality of gage cutter elements being primary cutter elements that cooperatively cut the corner of the borehole before said gage cutter elements have undergone appreciable wear; and a plurality of inner row cutter elements secured to said cone cutter on said conical surface in a third circumferential row that is spaced apart from said first and second rows, said inner row cutter elements having cutting surfaces of a third preselected nominal wear resistance; and wherein said second preselected nominal wear resistance is greater than said third preselected nominal wear resistance.

2. The bit of claim 1 wherein said cutting surface of at least one of said nestled gage cutter elements is continuously contoured.

3. The bit of claim 2 wherein said first preselected nominal wear resistance is greater than said second preselected nominal wear resistance.

4. The bit of claim 3 further comprising a plurality of heel row cutter elements secured to said cone cutter in said heel surface in a fourth circumferential row, said heel cutter elements having cutting surfaces of a fourth preselected nominal wear resistance that extend to full gage.

5. The bit of claim 4 wherein said fourth preselected nominal wear resistance is greater than said second preselected nominal wear resistance.

6. The bit of claim 4 wherein said fourth nominal wear resistance is not less than said first nominal wear resistance.

7. The bit of claim 2 wherein said cutting surface of said one gage cutter element is continuously contoured.

8. The bit of claim 7 wherein said cutting surfaces of said one nestled gage cutter element and said one gage cutter elements are entirely covered with PCD.

9. The bit of claim 8 wherein said first preselected nominal wear resistance is greater than said second preselected nominal wear resistance.

10. The bit of claim 2 wherein said cutting surface of said one nestled gage cutter element is entirely covered with superabrasive.

11. The bit of claim 10 further comprising a plurality of heel row cutter elements secured to said cone cutter in said heel surface in a fourth circumferential row, said heel cutter elements having cutting surfaces of a fourth preselected nominal wear resistance that extend to full gage, said fourth preselected nominal wear resistance being greater than said second preselected nominal wear resistance.

12. The bit of claim 2 wherein said one nestled gage cutter element engages the borehole wall with a negative rake angle throughout its engagement with the borehole wall.

13. The bit of claim 1 wherein said cutting surface of at least one of said nestled gage cutter elements is fully covered with a super abrasive.

14. The bit of claim 13 wherein said cutting surface of said one nestled gage cutter element is hemispherical.

15. The bit of claim 13 wherein said cutting surface of said one nestled gage cutter element includes a crest.

16. The bit of claim 15 where said one nestled gage cutter element includes an element axis, and wherein said crest is inclined with respect to a plane that is perpendicular to said element axis.

17. The bit of claim 13 wherein said cutting surface of said one gage cutter elements is continuously contoured and is entirely covered with PCD.

18. The bit of claim 1 further comprising a plurality of heel row cutter elements secured to said cone cutter in said heel surface in a fourth circumferential row, said heel cutter elements extending to full gage.

19. The bit of claim 1 wherein said cutting surfaces of at least one of said nestled gage cutter elements and at least one of said gage cutter elements each include portions having a PCD layer.

20. The bit of claim 19 wherein said cutting surface of said one nestled gage cutter element is fully covered with PCD.

21. The bit of claim 20 wherein said cutting surface of said one gage cutter element is covered with PCD.

22. The bit of claim 21 wherein said first preselected nominal wear resistance is greater than said second preselected nominal wear resistance.

23. The bit of claim 21 wherein said gage cutter elements have chisel shaped cutting surfaces.

24. The bit of claim 21 wherein said one gage row cutter element includes a cutting surface having a crest.

25. The bit of claim 24 wherein said one gage row cutter element includes an element axis and wherein said crest of said one gage cutter element is inclined with respect to a plane that is perpendicular to said element axis.

26. The bit of claim 1 wherein said bit has an IADC formation classification within the range of 41 to 62 and said gage cutter elements and said nestled gage cutter elements are inserts; and wherein said nestled gage inserts are mounted so as to have a predetermined extension, said nestled gage inserts and said gage inserts defining a step distance; and wherein the ratio of said step distance to said predetermined extension is not less than 0.8.

27. The bit of claim 1 wherein said gage cutter elements and said nestled gage cutter elements are inserts having cutting profiles that partially overlap when viewed in rotated profile to create a distance of overlap; and wherein said nestled gage inserts have a cylindrical base portion of a first diameter, and wherein the ratio of said distance of overlap to said first diameter is greater than 0.4.

28. The bit of claim 1 wherein said nestled gage cutter elements are inserts having a cylindrical base portion of a first diameter, and said gage cutter elements are inserts having a cylindrical base portion of a second diameter, and wherein the ratio of said first diameter to said second diameter is not greater than 0.75.

29. The bit of claim 1 wherein said cutting surface of at least a given one of said nestled gage cutter elements includes a planar surface, a continuously contoured transition surface, and an arcuate cutting edge at the intersection of said planar surface and said transition surface.

30. The bit of claim 29 wherein said transition surface includes a superabrasive coating.

31. An earth-boring bit having a nominal gage diameter for drilling a borehole, the bit comprising:

a bit body having a bit axis;

at least one rolling cone cutter rotatably mounted on said bit body and having a generally conical surface and an adjacent heel surface that intersect in a circumferential shoulder;

a plurality of nestled gage cutter elements secured to said cone cutter in a first circumferential row adjacent to said shoulder, said plurality of nestled gage cutter elements having cemented tungsten carbide cutting surfaces of a first preselected nominal wear resistance that extend to full gage;

a plurality of gage cutter elements secured to said cone cutter on said conical surface in a second circumferential row that is spaced apart from said first row, said plurality of gage cutter elements extending to full gage and having cutting surfaces of a super abrasive having a second preselected nominal wear resistance;

said plurality of nestled gage cutter elements and said plurality of gage cutter elements being primary cutter elements and cooperatively cutting the corner of the borehole before said gage cutter elements have undergone appreciable wear.

32. The bit of claim 31 wherein said cutting surface of at least a given one of said nestled gage cutter elements is continuously contoured.

33. The bit of claim 32 wherein said cutting surface of said one nestled gage cutter element includes a crest.

34. The bit of claim 32 wherein said cutting surface of said one nestled gage cutter element is hemispherical.

35. The bit of claim 31 wherein said cutting surface of at least a given one of said nestled gage cutter elements engages the borehole wall with a negative rake angle.

36. The bit of claim 35 wherein said cutting surface of at least a given one of said gage cutter elements is continuously contoured.

37. The bit of claim 36 wherein said cutting surface of said one gage cutter element includes an inclined crest.

38. The bit of claim 31 further comprising a plurality of heel row cutter elements secured to said cone cutter in said heel surface in a third circumferential row, said heel cutter elements extending to full gage and having a preselected nominal wear resistance not less than said first nominal wear resistance.

39. An earth-boring bit having a nominal gage diameter for drilling a borehole, the bit comprising:

a bit body having a bit axis;

at least one rolling cone cutter rotatably mounted on said bit body and having a generally conical surface and an adjacent heel surface that intersect in a circumferential shoulder;

a plurality of nestled gage cutter elements secured to said cone cutter in a first circumferential row adjacent to said shoulder, said plurality of nestled gage cutter elements extending to full gage and having cutting surfaces of a super abrasive having a first preselected nominal wear resistance;

a plurality of gage cutter elements secured to said cone cutter on said conical surface in a second circumferential row that is spaced apart from said first row, said plurality of gage cutter elements extending to full gage and having cutting surfaces of a super abrasive having a second preselected nominal wear resistance;

said plurality of nestled gage cutter elements and said plurality of gage cutter elements being primary cutter elements and cooperatively cutting the corner of the borehole before said gage cutter elements have undergone appreciable wear.

40. The bit of claim 39 wherein said first nominal wear resistance is greater than said second nominal wear resistance.

41. The bit of claim 40 wherein said super abrasive coating on said nestled gage cutter elements is a coating of PCD having an average grain size not greater than 25 $\mu$m, and wherein said super abrasive coating on said gage cutter elements is a coating of PCD having an average grain size greater than 25 $\mu$m.

42. The bit of claim 41 further comprising a plurality of inner row cutter elements secured to said cone cutter on said conical surface in a third circumferential row that is spaced apart from said first and second rows, said inner row cutter elements having cutting surfaces of a third preselected nominal wear resistance that is less than said second preselected nominal wear resistance.

43. The bit of claim 42 further comprising a plurality of heel row cutter elements secured to said cone cutter and said heel surface in a fourth circumferential row, said heel cutter elements having cutting surfaces of a fourth preselected nominal wear resistance that extend to full gage, said fourth preselected nominal wear resistance being not less than said second preselected nominal wear resistance.

44. The bit of claim 42 wherein said cutting surfaces of said cutter elements on said inner row include a coating of PCD having an average grain size greater than 25 $\mu$m.

45. The bit of claim 39 further comprising a plurality of inner row cutter elements secured to said cone cutter on said conical surface in a third circumferential row that is spaced apart from said first and second rows, said inner row cutter elements having cutting surfaces of a third preselected nominal wear resistance; and wherein said second preselected nominal wear resistance is greater than said third preselected nominal wear resistance.

46. The bit of claim 45 wherein said cutting surface of said nestled gage cutter elements is continuously contoured.

47. The bit of claim 46 wherein said super abrasive coating on said nestled gage cutter elements is a coating of PCD having an average grain size not greater than 25 $\mu$m, and wherein said super abrasive coating on said gage cutter elements is a coating of PCD having an average grain size greater than 25 $\mu$m.

48. The bit of claim 45 further comprising a plurality of heel row cutter elements secured to said cone cutter in said heel surface in a fourth circumferential row, said heel cutter elements extending to full gage and having cutting surfaces of a fourth preselected nominal wear resistance.

49. The bit of claim wherein:

said first nominal wear resistance is not less than said second nominal wear resistance; and said fourth nominal wear resistance is not less than said second nominal wear resistance.

50. An earth-boring bit having a nominal gage diameter for drilling a borehole, the bit comprising:

a bit body having a bit axis;

at least one rolling cone cutter rotatably mounted on said bit body and having a generally conical surface and an adjacent heel surface that intersect in a circumferential shoulder;

a plurality of nestled gage inserts secured to said cone cutter in a first circumferential row adjacent to said shoulder, said nestled gage inserts having cutting surfaces of a first preselected nominal wear resistance that extend to full gage;

a plurality of steel gage teeth secured to said cone cutter on said conical surface in a second circumferential row that is spaced apart from said first row, said gage teeth having gage facing cutting surfaces of a second preselected nominal wear resistance that extend to full gage;

wherein said nestled gage inserts and said gage teeth being primary cutter elements that cooperatively cut the corner of the borehole before said gage teeth have undergone appreciable wear.

51. The bit of claim 50 further comprising:

a plurality of inner row steel teeth secured to said cone cutter on said conical surface in a third circumferential row that is spaced apart from said first and second rows, said inner row teeth having cutting surfaces of a third preselected nominal wear resistance; and wherein said second preselected nominal wear resistance is greater than said third preselected nominal wear resistance.

52. The bit of claim 50 wherein said nestled gage inserts engage the borehole with a negative rake angle.

53. The bit of claim 50 wherein at least one of said nestled gage inserts has a cutting surface that is continuously contoured.

54. The bit of claim 53 wherein said cutting surface of said one nestled gage insert is entirely covered with a superabrasive.

55. The bit of claim 54 wherein said cutting surface of said one nestled gage insert includes a crest.

56. The bit of claim 50 wherein said gage facing surfaces of said gage teeth is hardfaced, and wherein said first nominal wear resistance is greater than said second nominal wear resistance.

57. The bit of claim 56 further comprising:

a plurality of inner row steel teeth secured to said cone cutter on said conical surface in a third circumferential row that is spaced apart from said first and second rows, said inner row teeth having cutting surfaces with hardfacing of a third preselected nominal wear resistance; and wherein said second nominal wear resistance is greater than said third nominal wear resistance.

58. The bit of claim 50 wherein said nestled gage inserts are mounted so as to have a predetermined extension, said nestled gage inserts and said gage teeth defining a step distance; and wherein the ratio of said step distance to said extension is not less than 0.8.

59. The bit of claim 50 wherein said cutting surface of at least a given one of said nestled gage cutter elements include a planar surface, a continuously contoured transition surface, and an arcuate cutting edge at the intersection of said planar surface and said transition surface.

60. The bit of claim 59 wherein said transition surface includes a superabrasive coating.

61. The bit of claim 50 wherein said cutting surface of at least one of said nestled gage cutter elements includes a portion that has a PCD coating.

62. An earth-boring bit having a nominal gage diameter for drilling a borehole, the bit comprising:

a bit body having a bit axis;

at least one rolling cone cutter rotatably mounted on said bit body and having a generally conical surface and an adjacent heel surface that intersect in a circumferential shoulder;

a plurality of nestled gage cutter elements secured to said cone cutter in a first circumferential row adjacent to said shoulder, said plurality of nestled gage cutter elements having cutting surfaces that extend to full gage and engage the borehole wall with a negative rake angle;

a plurality of gage cutter elements secured to said cone cutter on said conical surface in a second circumferential row that is spaced apart from said first row, said plurality of gage cutter elements having cutting surfaces that extend to full gage;

said plurality of nestled gage cutter elements and said plurality of gage cutter elements being primary cutter elements that cooperatively cut the corner of the borehole before said gage cutter elements have undergone appreciable wear; and wherein said cutting surface of said nestled gage cutter elements include a planar surface, a PCD coated non planar surface, and a cutting edge at the intersection of said planar and non planar surfaces.

63. The bit of claim 62 wherein said non planar surface is a continuously contoured surface and wherein said cutting surface of said nestled gage cutter element is positioned in said cone cutter so as to include a relief angle between said planar surface and the borehole.

* * * * *